US010696043B2

(12) United States Patent
Sakamoto et al.

(10) Patent No.: US 10,696,043 B2
(45) Date of Patent: Jun. 30, 2020

(54) INK JET PRINTING APPARATUS AND INK JET PRINTING METHOD

(71) Applicant: CANON KABUSHIKI KAISHA, Tokyo (JP)

(72) Inventors: Atsushi Sakamoto, Yokohama (JP); Satoshi Masuda, Yokohama (JP); Yoshiyuki Honda, Yokohama (JP); Toru Yamane, Yokohama (JP); Kyosuke Deguchi, Yokohama (JP); Ryosuke Hirokawa, Kawasaki (JP); Toru Ohnishi, Yokohama (JP); Akihiro Mouri, Fuchu (JP); Noboru Toyama, Kawasaki (JP); Toshimori Miyakoshi, Yokohama (JP); Hiroaki Motooka, Kawasaki (JP); Ryohei Goto, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/026,202

(22) Filed: Jul. 3, 2018

(65) Prior Publication Data

US 2018/0311951 A1 Nov. 1, 2018

Related U.S. Application Data

(63) Continuation of application No. PCT/JP2016/005250, filed on Dec. 28, 2016.

(30) Foreign Application Priority Data

Jan. 5, 2016 (JP) ..... 2016-000745
Jan. 5, 2016 (JP) ..... 2016-000747
(Continued)

(51) Int. Cl.
*B41J 2/005* (2006.01)
*B41J 29/17* (2006.01)
(Continued)

(52) U.S. Cl.
CPC ..... *B41J 2/0057* (2013.01); *B41J 11/0015* (2013.01); *B41J 29/17* (2013.01);
(Continued)

(58) Field of Classification Search
CPC ..... B41J 2/0057; B41J 11/0015; B41J 29/17; B41J 29/38; B41M 5/0017; B41M 7/00
See application file for complete search history.

(56) References Cited

U.S. PATENT DOCUMENTS 5,008,690 A 4/1991 Koizumi et al.
5,841,456 A 11/1998 Takei et al.
(Continued)

FOREIGN PATENT DOCUMENTS

CN 1990241 A 7/2007
CN 101332708 A 12/2008
(Continued)

OTHER PUBLICATIONS

International Search Report and Written Opinion dated Mar. 6, 2017, in International Application No. PCT/JP2016/005250.
(Continued)

*Primary Examiner* — Geoffrey S Mruk
(74) *Attorney, Agent, or Firm* — Venable LLP

(57) ABSTRACT

On a conveyance path of a liquid absorbing member including a porous body, a liquid absorbing unit 2 that absorbs a first liquid from a first image, a recovery liquid applying unit 3 that applies a recovery liquid to the porous body absorbing the liquid and a liquid collecting unit 4 that collects a liquid component absorbed by the porous body are arranged in this order, and a cleaning unit 5 that brings a cleaning member into contact with the conveyance path of the porous body is disposed at least between the liquid absorbing unit and the recovery liquid applying unit or between the liquid collecting unit and the liquid absorbing unit.

10 Claims, 9 Drawing Sheets

(30) Foreign Application Priority Data

| | | |
|---|---|---|
| Feb. 15, 2016 | (JP) | 2016-026419 |
| May 27, 2016 | (JP) | 2016-106239 |
| May 30, 2016 | (JP) | 2016-107448 |
| May 30, 2016 | (JP) | 2016-107949 |

(51) Int. Cl.

| | |
|---|---|
| ***B41J 29/38*** | (2006.01) |
| ***B41M 7/00*** | (2006.01) |
| ***B41J 11/00*** | (2006.01) |
| ***B41M 5/00*** | (2006.01) |

(52) U.S. Cl.

CPC ..... *B41J 29/38* (2013.01); *B41M 5/0017* (2013.01); *B41M 7/00* (2013.01)

(56) References Cited

U.S. PATENT DOCUMENTS

| | | | | |
|---|---|---|---|---|
| 6,916,081 | B2 | 7/2005 | Nakashima | |
| 7,129,284 | B2 | 10/2006 | Ma et al. | |
| 7,419,257 | B2 | 9/2008 | Mouri et al. | |
| 7,422,318 | B2 | 9/2008 | Kadomatsu et al. | |
| 7,481,526 | B2 | 1/2009 | Inoue | |
| 7,494,213 | B2 | 2/2009 | Taniuchi et al. | |
| 7,497,564 | B2 | 3/2009 | Yui | |
| 7,556,342 | B2 | 7/2009 | Hamano | |
| 7,594,722 | B2 | 9/2009 | Kadomatsu et al. | |
| 7,766,457 | B2 | 8/2010 | Chen | |
| 7,845,760 | B2 | 12/2010 | Hirakawa | |
| 7,926,933 | B2 | 4/2011 | Taniuchi et al. | |
| 7,997,717 | B2 | 8/2011 | Taniuchi et al. | |
| 8,220,917 | B2 | 7/2012 | Taniuchi et al. | |
| 8,226,225 | B2 | 7/2012 | Yamanobe | |
| 8,246,158 | B2 | 8/2012 | Ageishi et al. | |
| 8,857,962 | B2 | 10/2014 | Goto et al. | |
| 8,985,737 | B2 * | 3/2015 | Momose | B41J 11/007 347/22 |
| 9,067,449 | B2 | 6/2015 | Morita et al. | |
| 9,102,137 | B2 | 8/2015 | Koitabashi et al. | |
| 9,616,653 | B2 | 4/2017 | Liu | |
| 9,769,171 | B2 | 9/2017 | Gomi | |
| 9,821,584 | B2 | 11/2017 | Noguchi et al. | |
| 9,925,802 | B2 | 3/2018 | Nishitani et al. | |
| 10,046,556 | B2 | 8/2018 | Soma et al. | |
| 10,137,690 | B2 | 11/2018 | Hirokawa et al. | |
| 2006/0055755 | A1 | 3/2006 | Yui | |
| 2006/0061642 | A1 | 3/2006 | Ueki | |
| 2006/0170752 | A1 | 8/2006 | Kadomatsu et al. | |
| 2006/0221166 | A1 | 10/2006 | Inoue | |
| 2007/0229586 | A1 | 10/2007 | Hirakawa | |
| 2008/0055356 | A1 | 3/2008 | Yamanobe | |
| 2008/0236480 | A1 | 10/2008 | Furukawa et al. | |
| 2009/0079784 | A1 | 3/2009 | Chiwata et al. | |
| 2011/0069109 | A1 | 3/2011 | Tojo | |
| 2015/0306539 | A1 | 10/2015 | Yamato | |
| 2016/0185110 | A1 | 6/2016 | Masuda et al. | |
| 2017/0217216 | A1 | 8/2017 | Ohnishi et al. | |
| 2018/0178552 | A1 | 6/2018 | Nishitani et al. | |
| 2018/0304615 | A1 | 10/2018 | Soma et al. | |
| 2018/0319179 | A1 | 11/2018 | Yamane et al. | |
| 2018/0319188 | A1 | 11/2018 | Toyama et al. | |
| 2018/0326719 | A1 | 11/2018 | Masuda et al. | |
| 2018/0326755 | A1 | 11/2018 | Ohnishi et al. | |
| 2018/0326756 | A1 | 11/2018 | Hirokawa et al. | |
| 2018/0345702 | A1 | 12/2018 | Deguchi et al. | |
| 2019/0001710 | A1 | 1/2019 | Hirokawa et al. | |
| 2019/0009515 | A1 | 1/2019 | Deguchi et al. | |
| 2019/0009546 | A1 | 1/2019 | Sakamoto et al. | |
| 2019/0009549 | A1 | 1/2019 | Takada et al. | |
| 2019/0009550 | A1 | 1/2019 | Inoue et al. | |
| 2019/0009551 | A1 | 1/2019 | Goto et al. | |
| 2019/0009577 | A1 | 1/2019 | Hirokawa et al. | |
| 2019/0009578 | A1 | 1/2019 | Takeuchi et al. | |
| 2019/0009579 | A1 | 1/2019 | Inoue et al. | |
| 2019/0009589 | A1 | 1/2019 | Hirokawa et al. | |
| 2019/0009592 | A1 | 1/2019 | Okushima et al. | |
| 2019/0009594 | A1 | 1/2019 | Sakamoto et al. | |
| 2019/0016112 | A1 | 1/2019 | Tsushima et al. | |

FOREIGN PATENT DOCUMENTS

| | | | |
|---|---|---|---|
| CN | 100546832 | C | 10/2009 |
| CN | 101607468 | A | 12/2009 |
| CN | 103660656 | A | 3/2014 |
| CN | 105593020 | A | 5/2016 |
| EP | 2 123 459 | A2 | 11/2009 |
| EP | 2 777 941 | A1 | 9/2014 |
| JP | 2000-103157 | A | 4/2000 |
| JP | 2000-288483 | A | 10/2000 |
| JP | 2001-171143 | A | 6/2001 |
| JP | 2001-179959 | A | 7/2001 |
| JP | 2004-043047 | A | 2/2004 |
| JP | 2004-181955 | A | 7/2004 |
| JP | 2005-016160 | A | 6/2005 |
| JP | 2005-161610 | A | 6/2005 |
| JP | 2006-082428 | A | 3/2006 |
| JP | 2006-088486 | A | 4/2006 |
| JP | 2006-102981 | A | 4/2006 |
| JP | 2006-205677 | A | 8/2006 |
| JP | 2006-264080 | A | 10/2006 |
| JP | 2007-268974 | A | 10/2007 |
| JP | 2007-268975 | A | 10/2007 |
| JP | 4016559 | B2 | 12/2007 |
| JP | 2008-055852 | A | 3/2008 |
| JP | 2008-213333 | A | 9/2008 |
| JP | 2008-246787 | A | 10/2008 |
| JP | 2009-000915 | A | 1/2009 |
| JP | 2009-000916 | A | 1/2009 |
| JP | 2009-045851 | A | 3/2009 |
| JP | 2009-061644 | A | 3/2009 |
| JP | 2008-087283 | A | 4/2009 |
| JP | 2009-072927 | A | 4/2009 |
| JP | 2009-086348 | A | 4/2009 |
| JP | 2009-159116 | A | 7/2009 |
| JP | 2009-166387 | A | 7/2009 |
| JP | 2009-214439 | A | 9/2009 |
| JP | 2009-226852 | A | 10/2009 |
| JP | 2009-234219 | A | 10/2009 |
| JP | 2010-201796 | A | 9/2010 |
| JP | 2011-063001 | A | 3/2011 |
| JP | 2011-245865 | A | 12/2011 |
| JP | 2012-116617 | A | 6/2012 |
| JP | 2012-183798 | A | 9/2012 |
| JP | 2013-010267 | A | 1/2013 |
| JP | 2014-193599 | A | 10/2014 |
| JP | 2015-016687 | A | 1/2015 |
| JP | 2015-096562 | A | 5/2015 |
| JP | 2015-098097 | A | 5/2015 |
| JP | 2015-145117 | A | 8/2015 |
| JP | 2015-150789 | A | 8/2015 |
| JP | 2015-208881 | A | 11/2015 |
| JP | 2016-120625 | A | 7/2016 |
| WO | 2015/034027 | A1 | 3/2015 |
| WO | 2018/105215 | A1 | 6/2018 |

OTHER PUBLICATIONS

Chinese Office Action, dated Apr. 25, 2019, issued in Chinese Patent Application No. 201680078100.3.

Chinese Office Action, dated Apr. 25, 2019, issued in Chinese Patent Application No. 201680078027.X.

Chinese Office Action, dated Apr. 28, 2019, issued in Chinese Patent Application No. 201680078028.4.

Chinese Office Action, dated May 24, 2019, issued in Chinese Patent Application No. 201680078084.8.

Extended European Search Report, dated Jul. 11, 2019, issued in European Patent Application No. 16883554.4.

Extended European Search Report, dated Jul. 12, 2019, issued in European Patent Application No. 16883553.6.

Extended European Search Report, dated Jul. 12, 2019, issued in European Patent Application No. 16883551.0.

(56) References Cited

OTHER PUBLICATIONS

Extended European Search Report, dated Jul. 12, 2019, issued in European Patent Application No. 16883550.2.
Extended European Search Report, dated Jul. 23, 2019, issued in European Patent Application No. 16883546.0.
Extended European Search Report, dated Jul. 23, 2019, issued in European Patent Application No. 16883549.4.
International Search Report, dated Mar. 7, 2017, issued in International Patent Application No. PCT/JP2016/005241.
International Search Report, dated Mar. 28, 2017, issued in International Patent Application No. PCT/JP2016/005248.
International Search Report, dated Mar. 28, 2017, issued in International Patent Application No. PCT/JP2016/005246.
International Search Report, dated Mar. 7, 2017, issued in International Patent Application No. PCT/JP2016/005242.
International Search Report, dated Mar. 21, 2017, issued in International Patent Application No. PCT/JP2016/005247.
International Search Report, dated Mar. 28, 2017, issued in International Patent Application No. PCT/JP2016/005244.
International Search Report, dated Mar. 7, 2017, issued in International Patent Application No. PCT/JP2016/005249.
International Search Report, dated Apr. 4, 2017, issued in International Patent Application No. PCT/JP2016/005251.
International Search Report, dated Apr. 4, 2017, issued in International Patent Application No. PCT/JP2017/002666.
Singapore Search Report and Written Opinion dated Sep. 17, 2018, in SG Patent Application No. 11201805829P.
International Preliminary Report on Patentability dated Jul. 19, 2018, in International Application No. PCT/JP2016/005250.
Sep. 27, 2019 Chinese Official Action in Chinese Patent Appln. No. 201680078027.X.
Dec. 4, 2019 Korean Official Action in Korean Patent Appln. No. 10-2018-7021597.

* cited by examiner

INK JET PRINTING APPARATUS AND INK JET PRINTING METHOD

CROSS-REFERENCE TO RELATED APPLICATIONS

This application is a Continuation of International Patent Application No. PCT/JP2016/005250, filed Dec. 28, 2016, which claims the benefit of Japanese Patent Application Nos. 2016-026419, filed Feb. 15, 2016, 2016-107448, filed May 30, 2016, 2016-000747, filed Jan. 5, 2016, 2016-107949, filed May 30, 2016, 2016-000745, filed Jan. 5, 2016, 2016-106239, filed May 27, 2016 all of which are hereby incorporated by reference herein in their entirety.

BACKGROUND OF THE INVENTION

Field of the Invention

The present invention relates to an ink jet printing apparatus and an ink jet printing method.

Description of the Related Art

In an ink jet printing method, an image is formed by directly or indirectly applying a liquid composition (ink) containing a coloring material onto a printing medium such as paper. At this time, curling and cockling may occur due to excessive absorption of a liquid component in ink by the printing medium.

Here, in order to rapidly remove the liquid component in the ink, a method of drying a printing medium using means such as warm air or infrared rays or a method of forming an image on a transfer body, then drying a liquid component contained in the image on the transfer body by thermal energy or the like, and then transferring the image onto the printing medium such as paper is provided.

Further, as means for removing the liquid component contained in the image on the transfer body, a method of absorbing and removing the liquid component from the ink image by bringing a roller-shaped porous body into contact with the ink image without using thermal energy has been proposed (Japanese Patent Application Laid-Open No. 2009-45851).

In order to repeatedly use the above-described porous body, it is necessary to remove or collect the liquid once absorbed from the porous body before using the porous body again. At that time, a configuration in which even in a state where the liquid is absorbed by a portion of the porous body, occurrence of air vent is suppressed so as to uniformly remove and collect the liquid from the porous body without damaging the porous body is known. Specifically, a proposal has been made to perform a step of applying another liquid to a porous body and a step of removing or collecting the liquid absorbed by the porous body until liquid absorption is performed again using the porous body after performing the liquid absorption by allowing the porous body to abut on an ink image on a transfer body (Japanese Patent Application Laid-Open No. 2007-268975).

On the other hand, when the liquid component is absorbed and removed from the ink on the transfer body by the porous body, dirt derived from the ink may be attached to the porous body in some cases. In Japanese Patent Application Laid-Open No. 2000-288483, as a dustproof method of a flexible sheet to be used repeatedly, a method including a step of bringing a dust removing roller including a transfer roller having dust trapping capability and an adhesive roller into contact with a flexible sheet, and a step of blowing air onto the flexible sheet to perform a dust removal operation is disclosed.

In a case of repeatedly using the porous body in the ink jet printing apparatus for the purpose of absorbing and removing the liquid component from an ink aggregation on the transfer body by using the porous body, it is necessary to perform following initializing and cleaning steps before using the porous body again:

A step of uniformly applying another liquid to a porous body

A step of removing or collecting the liquid absorbed in a porous body

A step of removing dirt attached to a surface of a porous body

However, Japanese Patent Application Laid-Open No. 2009-45851 and Japanese Patent Application Laid-Open No. 2007-268975 disclose a method for collecting the liquid from the porous body in a case of repeatedly using the porous body used as an absorber, but there is no proposal such as cleaning dirt which is derived from the ink aggregation or the like and attached to the porous body.

Further, depending on the order of the initializing and cleaning steps of the porous body, the porous body cannot be repeatedly used because a predetermined function is not exerted. Specifically, when the step of removing dirt attached to the surface of the porous body is performed after the step of uniformly applying another liquid to the porous body, the dirt on the surface of the porous body remains without being removed, and then the dirt moves from the porous body to a printed image at the timing when the porous body and the printed image on the transfer body are brought into contact with each other, which may cause image defects in some cases. However, in Japanese Patent Application Laid-Open Nos. 2009-45851, 2007-268975 and 2000-288483, such problems are not recognized, and the order of initializing and cleaning steps of the porous body is not mentioned.

Therefore, an object of the present invention is to provide an ink jet printing apparatus and an ink jet printing method which are capable of repeatedly removing dirt attached to the surface of the porous body used as a liquid absorbing member, and capable of suppressing occurrence of image defects so as to realize stable image output even in a case of performing continuous image formation.

SUMMARY OF THE INVENTION

In order to solve the above-described problem, the present invention provides an ink jet printing apparatus including:

an image forming unit that forms a first image including a first liquid and a coloring material on an ink receiving medium by applying ink to the ink receiving medium;

a liquid absorbing member that includes a porous body which absorbs at least a portion of the first liquid from the first image;

a recovery liquid applying device that applies a recovery liquid having a viscosity lower than that of the ink to the porous body absorbing the first liquid, a liquid collecting device that collects the first liquid absorbed by the porous body;

a liquid absorbing member conveyance device that conveys the liquid absorbing member; and a cleaning member that cleans the porous body, in which on a conveyance path of the liquid absorbing member, a liquid absorbing unit that absorbs the first liquid from the first image by the porous body, a recovery liquid applying unit in which the recovery liquid is applied by the recovery liquid applying device, and a liquid collecting unit in which a liquid component absorbed by the porous body is collected by the liquid collecting device are arranged in this order, and a cleaning unit in which the porous body is cleaned by the cleaning member is disposed on at least between the liquid absorbing unit and the recovery liquid applying unit or between the liquid collecting unit and the liquid absorbing unit.

In addition, the present invention provides an ink jet printing method including:

an image forming step of forming a first image including a first liquid and a coloring material by applying an ink to an ink receiving medium;

a liquid absorbing step of absorbing at least a portion of the first liquid from the first image by a liquid absorbing member including a porous body;

a recovery liquid applying step of applying a recovery liquid having a viscosity lower than that of the ink to the porous body absorbing the first liquid; and a liquid collecting step of collecting the first liquid absorbed by the porous body, in which the liquid absorbing member is repeatedly subjected to the liquid absorbing step, the recovery liquid applying step, and the liquid collecting step in this order, and a cleaning step of cleaning the porous body by a cleaning member is disposed at least between the liquid absorbing step and the recovery liquid applying step or between the liquid collecting step and the liquid absorbing step.

Further features of the present invention will become apparent from the following description of exemplary embodiments with reference to the attached drawings.

DESCRIPTION OF THE EMBODIMENTS

Figure 1:
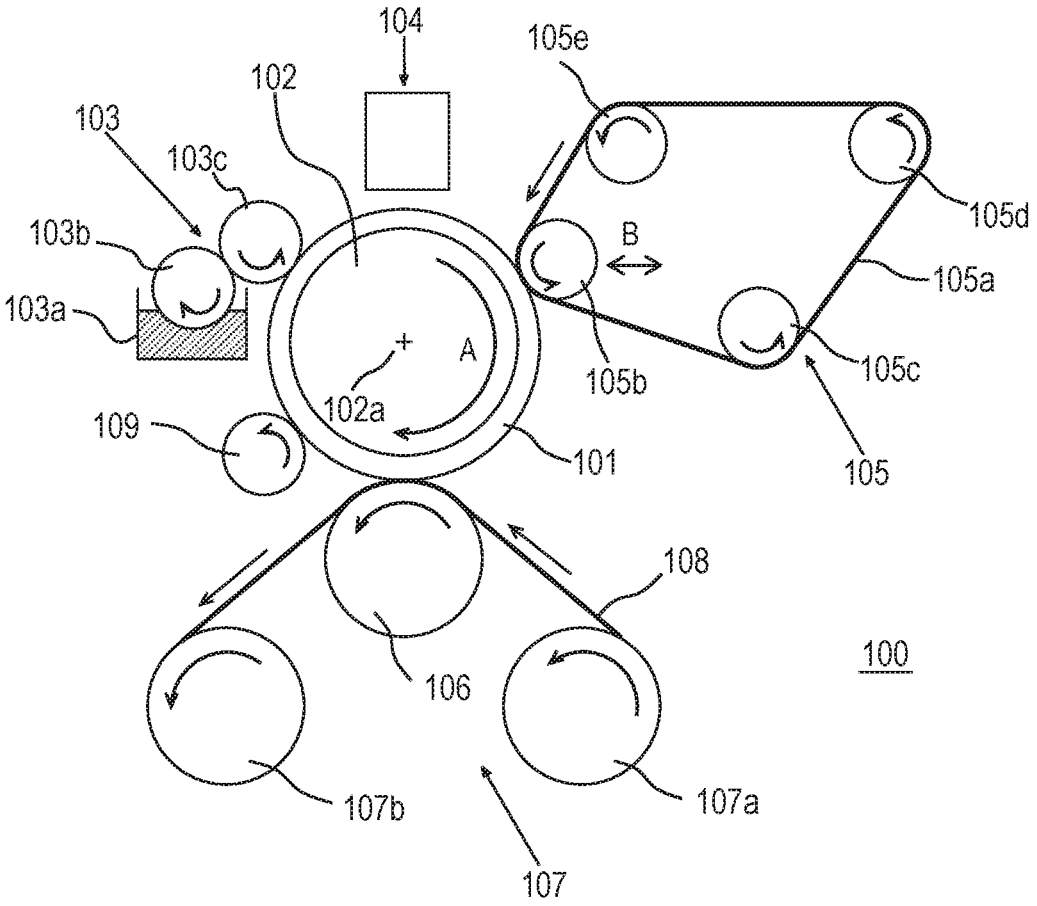
FIG. 1 is a schematic diagram illustrating one example of a configuration of a transfer type ink jet printing apparatus in one embodiment according to the present invention.

Hereinafter, the present invention will be described in detail with reference to preferred embodiments.

The ink jet printing apparatus of the present embodiment includes an image forming unit that forms a first image including a first liquid and a coloring material on an ink receiving medium; and a liquid absorbing member that includes a porous body which is brought into contact with the first image on a first surface so as to absorb at least a portion of the first liquid from the first image. When the liquid absorbing member including the porous body is brought into contact with the first image which contains the first liquid and the coloring material on the ink receiving medium, at least a portion of the first liquid is removed from the first image. As a result, curling and cockling caused by excessive absorption of the first liquid in the first image by the printing medium such as paper are suppressed.

In the ink jet printing apparatus of the present embodiment, the image forming unit is not particularly limited as long as it can form a first image including the first liquid and the coloring material on the ink receiving medium. The ink jet printing apparatus preferably includes 1) a device for applying a first liquid composition containing a first liquid or a second liquid onto an ink receiving medium; and 2) a device for applying a second liquid composition containing the first liquid or the second liquid, and the coloring material onto the ink receiving medium, and forms the first image as a mixture of the first liquid composition and the second liquid composition. In the present embodiment, the second liquid composition is ink containing the coloring material, and the device for applying the second liquid composition onto the ink receiving medium is an ink jet printing device. In addition, the first liquid composition contains a component which chemically or physically acts with the second liquid composition to thereby viscously thicken a mixture of the first liquid composition and second liquid composition more than each of the first and second liquid compositions. At least one of the first liquid composition and the second liquid composition includes the first liquid. Here, the first liquid includes a liquid having low volatility at normal temperature (room temperature), and particularly includes water. The second liquid is a liquid other than the first liquid, and although it does not matter whether the volatility is high or low, it is preferably a liquid having higher volatility than that of the first liquid. Hereinafter, the first liquid composition is referred to as a "reaction liquid", and the device for applying the first liquid composition onto the ink receiving medium is referred to as a "reaction liquid applying device". Further, the second liquid composition is referred to as "ink", and the device for applying the second liquid composition onto the ink receiving medium is referred to as an "ink applying device". In addition, the first image is an ink image before liquid removal before being subjected to liquid absorption treatment by the liquid absorbing member. An ink image after liquid removal in which the content of the first liquid is reduced by performing the liquid absorption treatment is referred to as a second image.

The ink jet printing apparatus according to the present embodiment further includes a recovery liquid applying device that applies a recovery liquid having a viscosity lower than that of ink and a reaction liquid to a porous body absorbing a liquid component; a liquid collecting device that collects a first liquid absorbed by the porous body included in a liquid absorbing member; and a liquid absorbing member conveyance device that conveys the liquid absorbing member. On the conveyance path of liquid absorbing member, a liquid absorbing unit in which the first liquid is absorbed by pressing the liquid absorbing member including the porous body to the first image by a pressing member, a recovery liquid applying unit in which the recovery liquid is applied by the recovery liquid applying device, and a liquid collecting unit in which a liquid component absorbed by the porous body is collected by the liquid collecting device are arranged in this order. Further, a cleaning unit that removes dirt attached to the first surface by bringing the cleaning member into contact with the first surface of the porous body is disposed at least between the liquid absorbing unit and the recovery liquid applying unit or between the liquid collecting unit and the liquid absorbing unit.

<Reaction Liquid Applying Device>

The reaction liquid applying device may be any device as long as the reaction liquid for a viscosity increase of an ink can be applied onto the ink receiving medium, and various known devices can be appropriately used. Specifically, examples thereof include a gravure offset roller, an ink jet head, a die coating device (die coater), and a blade coating device (blade coater). The application of the reaction liquid by the reaction liquid applying device may be performed before application of the ink or after application of the ink as long as the reaction liquid on the ink receiving medium can be mixed (reacted) with the ink. The reaction liquid is preferably applied before the application of the ink. When the reaction liquid is applied before the application of the ink, it is also possible to suppress bleeding in which adjacently applied inks are mixed with each other or beading in which the previously landed ink is attracted to the ink landed later at the time of image printing by an ink jet method.

<Reaction Liquid>

The reaction liquid contains a component that increases the viscosity of the ink (ink viscosity-increasing component). The reaction liquid thickens the ink by being in contact with the ink. Here, an increase in viscosity of an ink means that a coloring material, a resin, or the like which is a portion of the components constituting the ink chemically reacts by contact with an ink viscosity-increasing component, or physically adsorbs the ink viscosity-increasing component, and as a result, the increase in the viscosity of the ink is observed. The increase in viscosity of the ink includes not only the case where the increase in the ink viscosity is observed, but also a case where a portion of the component constituting the ink such as the coloring material and the resin aggregates and the viscosity is locally increased. As a method for aggregating a portion of the components constituting the ink, a reaction liquid which reduces the dispersion stability of the pigment in the aqueous ink can be used. The ink viscosity-increasing component has an effect of reducing the fluidity of a portion of the component constituting the ink and/or the ink on the ink receiving medium so as to suppress bleeding and beading during the first image formation. The increasing of the viscosity of the ink is also referred to as "viscously thickening the ink". Known materials such as a polyvalent metal ion, organic acid, a cationic polymer, and a porous fine particle can be used as such an ink viscosity-increasing component. Among these, the polyvalent metal ion and the organic acid are particularly preferable. In addition, it is also preferable to include plural kinds of the ink viscosity-increasing components. Note that, the content of the ink viscosity-increasing component in the reaction liquid is preferably 5% by mass or more with respect to the total mass of the reaction liquid.

Examples of the polyvalent metal ion include divalent metal ions such as $Ca^{2+}$, $cu^{2+}$, $Ni^{2+}$, $Mg^{2+}$, $Sr^{2+}$, $Ba^{2+}$ and $zn^{2+}$ and trivalent metal ions such as $Fe^{3+}$, $Cr^{3+}$, $Y^{3+}$ and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridine carboxylic acid, coumaric acid, thiophene carboxylic acid, nicotinic acid, oxysuccinic acid and dioxsuccinic acid.

The reaction liquid may contain water or an organic solvent of low volatility in an appropriate amount as the first liquid. Water used in this case is preferably deionized water by ion exchange or the like. The organic solvent that can be used in the reaction liquid is not particularly limited, and known organic solvents can be used.

The reaction liquid can be used by appropriately adjusting the surface tension and the viscosity by adding a surfactant or a viscosity adjusting agent. The material to be used is not particularly limited as long as it can coexist with the ink viscosity-increasing component. Specific examples of the surfactant include acetylene glycol ethylene oxide adduct ("Acetylenol E100" (product name), manufactured by Kawaken Fine Chemicals Co., Ltd.) and perfluoroalkyl ethylene oxide adduct ("Megafac F444" (product name), manufactured by DIC Corporation).

<Ink Applying Device>

An ink jet head is used as an ink applying device for applying ink. Examples of the ink jet head include a form in which ink is discharged by causing film boiling in the ink by an electro-thermal converter so as to form bubbles, a form in which ink is discharged by an electro-mechanical converter and a form in which ink is discharged by using static electricity. In the present invention, a known ink jet head can be used. Particularly, from the viewpoint of high-speed and high-density printing, one utilizing an electro-thermal converter is suitably used. Drawing receives an image signal and applies a necessary amount of ink to each position.

An ink applying amount can be expressed by the image density (duty) or the ink thickness; however, in the present embodiment, an average value obtained by multiplying the mass of each of the ink dots by the number of ink dots to be applied (the number of ink discharges) and dividing by the printing area was set as the ink applying amount ($g/m^2$). Note that, from the viewpoint of removing the liquid component in the ink, the maximum ink applying amount in the image region indicates an ink applying amount applied in an area of at least equal to or larger than 5 $mm^2$ in a region used as information of the ink receiving medium.

The ink jet printing apparatus of the present invention may include a plurality of ink jet heads for applying various colors of ink onto the ink receiving medium. For example, in a case of forming respective color images using yellow ink, magenta ink, cyan ink, and black ink, the ink jet printing apparatus includes four ink jet heads that discharge each of the above four kinds of ink onto an ink receiving medium. In addition, the ink applying device may include an ink jet head that discharges ink (clear ink) which does not contain a coloring material.

<Ink>

Each component of the ink applied to the present invention will be described.

(Coloring Material)

As the coloring material contained in the ink applied to the present invention, a pigment, or a mixture of a dye and a pigment can be used. The kinds of the pigments which can be used as a coloring material are not particularly limited. Specific examples of the pigment include an inorganic pigment such as carbon black; and an organic pigment such as an azo-based organic pigment, a phthalocyanine-based organic pigment, a quinacridone-based organic pigment, an isoindolinone-based organic pigment, an imidazolone-based organic pigment, a diketopyrrolopyrrole-based organic pigment and a dioxazine-based organic pigment. These pigments may be used alone or if necessary, two or more kinds thereof may be used in combination.

The kinds of the dyes which can be used as a coloring material are not particularly limited. Specific examples of the dye include direct dyes, acidic dyes, basic dyes, disperse dyes, edible dyes and the like and dyes having anionic groups can be used. Specific examples of the dye skeleton include an azo skeleton, a triphenylmethane skeleton, a phthalocyanine skeleton, an azaphthalocyanine skeleton, a xanthene skeleton and an anthrapyridone skeleton.

The content of the pigment in the ink is preferably 0.5% by mass or more to 15.0% by mass or less, and is more preferably 1.0% by mass or more to 10.0% by mass or less with respect to the total mass of the ink.

(Dispersant)

As a dispersant for dispersing the pigment, a known dispersant used for ink jet ink can be used. Among them, in the embodiment of the present invention, it is particularly preferable to use a water-soluble dispersant having both a hydrophilic portion and a hydrophobic portion in the structure thereof. In particular, a pigment dispersant containing a resin obtained by copolymerizing at least a hydrophilic monomer and a hydrophobic monomer is preferably used. The monomers used here are not particularly limited, and known monomers are preferably used. Specific examples of the hydrophobic monomer include styrene and other styrene derivatives, alkyl (meth)acrylate and benzyl (meth)acrylate. Examples of the hydrophilic monomer include acrylic acid, methacrylic acid and maleic acid.

The acid value of the dispersant is preferably 50 mgKOH/g or more to 550 mgKOH/g or less. In addition, a weight average molecular weight of the dispersant is preferably 1,000 or more to 50,000 or less. Note that, a mass ratio (pigment:dispersant) of the pigment to the dispersant is preferably in a range of 1:0.1 to 1:3.

It is also preferable to use a so-called self-dispersible pigment in which the pigment itself is surface-modified so that it can be dispersed without using a dispersant.

(Resin Fine Particle)

The ink applied to the present invention can contain various fine particles which do not contain coloring materials. Among these, the resin fine particle is effective in improving image quality and fixing property in some cases, and thus is preferable.

The materials of the resin fine particles that can be used in the present invention are not particularly limited, and known resins can be appropriately used. Specific examples thereof include a homopolymer such as polyolefin, polystyrene, polyurethane, polyester, polyether, polyurea, polyamide, polyvinyl alcohol, poly (meth)acrylic acid and salts thereof, alkyl poly (meth)acrylate, and polydiene, or a copolymer obtained by polymerizing a combination of a plurality of monomers for producing these homopolymers. The weight average molecular weight of the resin (Mw) is preferably 1,000 or more to 2,000,000 or less. The amount of the resin fine particles in the ink is preferably 1% by mass or more to 50% by mass or less, and is more preferably 2% by mass or more to 40% by mass or less, with respect to the total mass of the ink.

Further, in the embodiment of the present invention, it is preferable to use the resin fine particle dispersion in which the resin fine particles are dispersed in a liquid. The method of dispersion is not particularly limited, and a so-called self-dispersible type resin fine particle dispersion in which the resin fine particles are dispersed using a resin obtained by homopolymerizing a monomer having a dissociable group or copolymerizing a plurality of kinds of monomers is suitable. Here, examples of the dissociable group include a carboxyl group, a sulfonic acid group and a phosphoric acid group, and examples of the monomer having such a dissociable group include acrylic acid and methacrylic acid. In addition, a so-called emulsion dispersible type resin fine particle dispersion in which the resin fine particles are dispersed with an emulsifier can likewise be suitably used in the present invention. A known surfactant is preferable as the emulsifier, regardless of low molecular weight and high molecular weight. The surfactant is preferably a nonionic surfactant or a surfactant which has the electron of the same polarity as that of the resin fine particle.

The resin fine particle dispersion used in the embodiment of the present invention preferably has a dispersed particle diameter of 10 nm or more to 1,000 nm or less, and more preferably has a dispersed particle diameter of 50 nm or more to 500 nm or less, and still more preferably has a dispersed particle diameter of 100 nm or more to 500 nm or less.

In addition, when the resin fine particle dispersion used in the embodiment of the present invention is prepared, it is also preferable to add various additives for stabilization. Examples of such additives include n-hexadecane, dodecyl methacrylate, stearyl methacrylate, chlorobenzene, dodecyl mercaptan, blue dye (bluing agent) and polymethyl methacrylate.

(Surfactant)

The ink that can be used in the present invention may contain a surfactant. Specific examples of the surfactant include acetylene glycol ethylene oxide adduct (Acetylenol E100, manufactured by Kawaken Fine Chemicals Co., Ltd.) and the like. The amount of the surfactant in the ink is preferably 0.01% by mass or more to 5.0% by mass or less with respect to the total mass of the ink.

(Water and Water-Soluble Organic Solvent)

The ink used in the present invention may contain water and/or a water-soluble organic solvent as a solvent. Water is preferably deionized water by ion exchange or the like. In addition, the content of the water in the ink is preferably 30% by mass or more to 97% by mass or less with respect to the total mass of the ink, is more preferably 50% by mass or more to 95% by mass or less with respect to the total mass of the ink.

The kinds of the water-soluble organic solvent to be used are not particularly limited, and any of known organic solvents can be used. Specific examples thereof include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol and methanol. Of course, it is also possible to mix and use two or more kinds selected from them.

In addition, the content of the water-soluble organic solvent in the ink is preferably 3% by mass or more to 70% by mass or less with respect to the total mass of the ink.

(Other Additives)

In addition to the above components, as necessary, the ink that can be used in the present invention may contain other additives such as a pH adjuster, a rust preventive, an antiseptic, a mildewproofing agent, an antioxidant, a reduction preventing agent, a water soluble resin and its neutralizing agent, a viscosity adjusting agent and the like.

<Liquid Absorbing Member>

In the present invention, when at least a portion of the first liquid is absorbed from the first image by being brought into contact with the liquid absorbing member having the porous body, the content of the liquid component in the first image is decreased. The contact surface of the liquid absorbing member with the first image is set as the first surface, and the porous body is disposed on the first surface. The liquid absorbing member containing such a porous body preferably has a shape which is capable of absorbing the liquid by moving in conjunction with the movement of the ink receiving medium to come in contact with the first image, then circulating at a predetermined cycle, and then coming in contact with another first image again. For example, an endless belt shape or a drum shape can be exemplified.

[Porous Body]

It is preferable to use a porous body of the liquid absorbing member whose average pore diameter on the first surface side is smaller than the average pore diameter on the second surface side opposite to the first surface. In order to suppress the adhesion of the coloring material of the ink to the porous body, a pore diameter is preferably small, and an average pore diameter of the porous body on at least the first surface side which comes in contact with the image is preferably 10 μm or smaller. The average pore diameter means an average diameter on the first surface or the second surface, and can be measured by known means such as a mercury intrusion method, a nitrogen adsorption method, and a SEM image observation.

In addition, in order to uniformly provide high air permeability, it is preferable to reduce the thickness of the porous body. Air permeability can be indicated by the Gurley value defined in JIS P8117, and the Gurley value is preferably equal to or shorter than 10 seconds. However, if the porous body is thinned, the capacity necessary for absorbing the liquid component cannot be sufficiently ensured in some cases, so that it is possible to make the porous body into a multilayer configuration. Also, in the liquid absorbing member, it is sufficient if a layer in contact with the first image is a porous body, and layer not in contact with the first image may not be a porous body.

Next, embodiments in a case where the porous body has a multilayer configuration will be described. Here, a first layer on the side which is in contact with the first image, and as a second layer, a layer laminated on the surface opposite to the contact surface with the first image of the first layer will be described. Further, the configuration of the multilayer is sequentially expressed in the order of lamination from the first layer. In this specification, the first layer may be referred to as an "absorbing layer" and the second layer and subsequent layers may be referred to as a "supporting layer".

(First Layer)

In the present invention, the material of the first layer is not particularly limited, and any of a hydrophilic material having a contact angle to water of less than 90° and a water repellent material having a contact angle to water of equal to or larger than 90° can be used. In a case of a hydrophilic material, the contact angle to water is more preferably equal to or smaller than 40°. In a case where the first layer is formed of a hydrophilic material, it has the effect of sucking up aqueous liquid component, especially water by a capillary force.

The hydrophilic material is preferably selected from a single material such as cellulose and polyacrylamide, or a composite material thereof. Further, the surface of the water repellent material described below can also be used by being subjected to a hydrophilic treatment. Examples of the hydrophilic treatment include a sputter etching method, irradiation with radiation, $H_2O$ ion irradiation and excimer (ultraviolet) laser light irradiation.

Note that, the contact angle in this specification means an angle formed by dropping a measurement liquid onto a target and making a tangent of the droplet with a surface of the target at a portion where the droplet is in contact with the target. Although there are several kinds of measurement techniques, it is possible to measure the water repellency according to the technique disclosed in "6. Sessile Drop Method" of JIS R3257, for example.

On the other hand, it is preferable that the material of the first layer is a water repellent material having low surface free energy, particularly fluororesin, in order to suppress coloring material adhesion and to improve the cleaning property. Specific examples of the fluororesin include polytetrafluoroethylene (PTFE), polychlorotrifluoroethylene (PCTFE), polyvinylidene fluoride (PVDF), polyvinyl fluoride (PVF), perfluoroalkoxy fluororesin (PFA), a tetrafluoroethylene-propylenehexafluoride copolymer (FEP), an ethylene-tetrafluoroethylene copolymer (ETFE) and an ethylene chlorotrifluoroethylene copolymer (ECTFE). One or two or more kinds of these resins can be used as necessary, or a structure in which a plurality of films are laminated in the first layer may be used. In a case where the first layer is made of a water repellent material, there is almost no effect of sucking up the aqueous liquid component by a capillary force, and it may take time to suck up the aqueous liquid component when being brought into contact with the image for the first time. Therefore, it is preferable that a liquid having a contact angle with the first layer of less than 90° is impregnated in the first layer in advance. With respect to the first liquid and the optional second liquid in the first image, the liquid which is impregnated into the first layer in advance may be referred to as a "third liquid" or a "wetting liquid" in some cases. The third liquid can be impregnated into the first layer by being applied from the first surface of the liquid absorbing member. The third liquid is preferably prepared by mixing a surfactant and a liquid having a low contact angle with the first layer in the first liquid (water).

In the present invention, the film thickness of the first layer is preferably 50 μm or smaller. The film thickness is more preferably 30 μm or smaller. In examples of the present invention, the film thickness was obtained by measuring the film thickness of optional 10 points with a straight type micrometer (OMV-25, manufactured by Mitutoyo Corporation) and calculating the average value thereof.

The first layer can be produced by a known method for producing a thin film porous membrane. For example, it can be obtained by molding a resin material into a sheet shape by a method such as extrusion molding, and stretching it to a predetermined thickness. Further, a plasticizer such as paraffin is added to a material at the time of extrusion molding, and the plasticizer is removed by heating or the like at the time of stretching so as to obtain a porous membrane. The pore diameter can be adjusted by appropriately adjusting the amount of the plasticizer to be added, a draw ratio and the like.

(Second Layer)

In the present invention, the second layer is preferably a layer having air permeability. Such a layer may be a nonwoven fabric of a resin fiber or a woven fabric. The material of the second layer is not particularly limited, and is preferably a material in which the contact angle with the first liquid is the same as or lower than that of the first layer so that the liquid absorbed to the first layer side does not flow backward. Specifically, the material of the second layer is preferably selected from a single material such as polyolefin (such as polyethylene (PE), polypropylene (PP)), polyurethane, polyamide such as nylon, polyester (polyethylene terephthalate (PET) and the like), and polysulfone (PSF), composites thereof or the like. In addition, the second layer is preferably a layer having a pore diameter larger than that of the first layer.

(Third Layer)

In the present invention, the porous body having the multilayer structure may have a configuration having three or more layers, and is not limited thereto. A nonwoven fabric is preferable as a third layer (also, referred to as a third layer) and subsequent layers in view point of rigidity. The material which is the same as the second layer can be used.

[Other Materials]

The liquid absorbing member may have a reinforcing member for reinforcing the side surface of the liquid absorbing member in addition to the above-described porous body having the laminated structure. Further, the liquid absorbing member may have a joining member for joining longitudinal end portions of a long sheet-shaped porous body to form a belt-like member. As such a material, a non-porous tape material or the like can be used, and may be disposed at a position or a period where the material is not in contact with the image.

[Method of Producing Porous Body]

The method of forming the porous body by laminating the first layer and the second layer is not particularly limited. The first layer and the second layer may only be overlapped or adhered to each other by using a method such as lamination by adhesive agent or lamination by heating. From the viewpoint of the air permeability, the lamination by heating is preferable in the present invention. Further, for example, by heating, a portion of the first layer or the second layer may be melted and laminated by adhesion. Alternatively, a fusing material such as a hot melt powder may be interposed between the first layer and the second layer such that the first layer and the second layer are adhered to each other by heating and thus are laminated. In the case of laminating the third or more layers, they may be laminated at once or may be laminated in order, and the order of laminating is appropriately selected. In the heating step, a lamination method of heating the porous body by sandwiching the porous body with the heated roller in a pressurized state is preferable.

Next, specific embodiments of an ink jet printing apparatus will be described.

Examples of the ink jet printing apparatus include an ink jet printing apparatus which forms a first image on a transfer body as an ink receiving medium, and transfers a second image which is an image after a first liquid has been absorbed by a liquid absorbing member to a printing medium, and an ink jet printing apparatus which forms a first image on a printing medium as an ink receiving medium. In the present invention, the former ink jet printing apparatus will hereinafter be referred to as a transfer type ink jet printing apparatus for the sake of convenience, and the latter ink jet printing apparatus will hereinafter be referred to as a direct drawing type ink jet printing apparatus for the sake of convenience.

Each ink jet printing apparatus will be described below.

<Transfer-Type Ink Jet Printing Apparatus>

FIG. 1 is a schematic diagram illustrating one example of a schematic configuration of a transfer type ink jet printing apparatus of the present embodiment.

A transfer type ink jet printing apparatus 100 includes a transfer body 101 for temporarily holding a first image and a second image obtained by absorbing and removing at least a portion of a first liquid from the first image. In addition, the transfer type ink jet printing apparatus 100 includes a pressing member 106 for transferring which transfers the second image onto a printing medium such as paper on which an image is to be formed, that is, a printing medium for forming a final image according to the intended use.

The transfer type ink jet printing apparatus 100 of the present invention includes the transfer body 101 supported by a support member 102, a reaction liquid applying device 103 for applying a reaction liquid onto the transfer body 101, an ink applying device 104 for applying ink onto the transfer body 101 on which the reaction liquid is applied so as to form the first image on the transfer body, a liquid absorbing device 105 for absorbing a liquid component from the first image on the transfer body, and the pressing member 106 for transferring the second image on the transfer body from which the liquid component has been removed by pressing the printing medium 108 onto the printing medium 108 such as paper. In addition, the transfer type ink jet printing apparatus 100 may include a transfer body cleaning member 109 for cleaning the surface of the transfer body 101 after the second image is transferred onto the printing medium 108.

The support member 102 rotates about a rotation axis 102*a* in the direction of an arrow A in FIG. 1. With the rotation of the support member 102, the transfer body 101 is moved. The application of the reaction liquid by the reaction liquid applying device 103 and the application of the ink by the ink applying device 104 are sequentially performed on the transfer body 101 to be moved, and thereby the first image is formed on the transfer body 101. The first image formed on the transfer body 101 is moved to a position where the first image comes into contact with the liquid absorbing member 105*a* of the liquid absorbing device 105 by the movement of the transfer body 101.

The liquid absorbing member 105*a* of the liquid absorbing device 105 moves in synchronization with the rotation of the transfer body 101. The first image formed on the transfer body 101 passes through a state of being in contact with the moving liquid absorbing member 105*a*. During this time, the liquid absorbing member 105*a* removes at least the liquid component containing the aqueous liquid component from the first image. The liquid component contained in the first image is removed by passing through the state of being in contact with the liquid absorbing member 105*a*. In this contact state, it is preferable that the liquid absorbing member 105*a* is pressed against the first image with a predetermined pressing force in order to effectively function the liquid absorbing member 105*a*.

The removal of the aqueous liquid component can be expressed from a different point of view as concentrating the ink constituting the first image formed on the transfer body. Concentrating the ink means that the proportion of the solid content contained in the ink, such as coloring material and resin, with respect to the liquid component contained in the ink increases owing to reduction in the liquid component.

Then, the second image after the aqueous liquid component has been removed from the first image is moved to a transfer unit which comes in contact with the printing medium 108 conveyed by a conveyance device for printing medium 107 by the movement of the transfer body 101. While the second image from which the liquid component is removed and the printing medium 108 are in contact with each other, the pressing member 106 presses the printing medium 108, and thereby an image (ink image) is transferred onto the printing medium. The post-transfer ink image transferred onto the printing medium 108 is a reverse image of the second image. In the following description, the post-transfer ink image may be referred to as a third image separately from the first image (the ink image before liquid removal) and the second image (the ink image after liquid removal) described above.

Note that, since the first image is formed by applying ink after the reaction liquid is applied onto the transfer body, the reaction liquid remains in a non-image region (a non-ink image forming area) without reacting with the ink. In this apparatus, the liquid absorbing member 105*a* comes in contact with not only the first image but also the unreacted reaction liquid, and the liquid component of the reaction liquid is also removed from the surface of the transfer body 101.

Therefore, in the above description, it is expressed and described that the liquid component is removed from the first image, but this is not limited to the meaning that the liquid component is removed from only the first image, but means that a liquid component is removed from at least the first image on the transfer body. For example, it is also possible to remove the liquid component in the reaction liquid applied to the outer region of the first image together with the first image. Note that, the liquid component is not particularly limited as long as it does not have a certain shape, has fluidity, and has a substantially constant volume. For example, water, an organic solvent or the like contained in the ink and the reaction liquid is exemplified as a liquid component.

Also, even in a case where the clear ink is contained in the first image, it is possible to concentrate the ink by the liquid absorption treatment. For example, when the clear ink is applied onto the color ink containing the coloring material applied onto the transfer body 101, the clear ink is present on the entire surface of the first image, or the clear ink is partially present at one or more places on the surface of the first image, and the color ink is present in other places. In the first image, in the places where the clear ink is present on the color ink, the porous body absorbs the liquid component of the clear ink on the surface of the first image and the liquid component of the clear ink moves. Accordingly, the liquid component in the color ink moves to the porous body side, and thereby the aqueous liquid component in the color ink is absorbed. On the other hand, in the places where a region of the clear ink and a region of the color ink are present on the surface of the first image, the respective liquid components of the color ink and the clear ink move to the porous body side, and thereby the aqueous liquid components are absorbed. Note that, the clear ink may contain a large amount of components for improving transferability of the image from the transfer body 101 to the printing medium. For example, the content of the component that increases the adhesiveness to the printing medium by heating may be higher than that of the color ink.

[Transfer Body]

A transfer body 101 includes a surface layer including an image forming surface. As a member of the surface layer, various materials such as a resin and ceramics can be appropriately used, but from the viewpoint of durability and the like, a material having high compressive elastic modulus is preferable. Specifically, examples thereof include a condensate obtained by condensing an acrylic resin, an acrylic silicone resin, a fluorine-containing resin, and a hydrolyzable organosilicon compound. In order to improve the wettability and the transferability of the reaction liquid, the surface treatment may be performed before use. Examples of the surface treatment include a frame treatment, a corona treatment, a plasma treatment, a polishing treatment, a roughening treatment, an active energy ray irradiation treatment, an ozone treatment, a surfactant treatment and a silane coupling treatment. These may be combined in plural. An optional surface shape can also be provided on the surface layer.

Further, it is preferable that the transfer body includes a compressible layer having a function of absorbing pressure variation. When the compressible layer is provided, the compressible layer absorbs the deformation and disperses the variation against local pressure variation so that it is possible to maintain excellent transferability even during high-speed printing. Examples of members of the compressible layer include acrylonitrile-butadiene rubber, acrylic rubber, chloroprene rubber, urethane rubber and silicone rubber. A rubber material is preferable in which, at the time of molding the rubber material, a predetermined amount of a vulcanizing agent, a vulcanization accelerator and the like are blended therein and a filler such as a foaming agent, a hollow fine particle or salt is further blended therein as necessary to make a porous material. As a result, a bubble portion is compressed with volume change for various pressure fluctuations, so that deformation in a direction other than the compression direction is small and a more stable transferability and the durability can be obtained. As the porous rubber material, there are one having continuous pore structure in which the pores are continuous to each other and one having independent pore structure in which the pores are independently separated from each other. In the present invention, any structure may be used, and these structures may be used in combination.

Further, the transfer body preferably includes an elastic layer between the surface layer and the compressible layer. As a member of the elastic layer, various materials such as resin, ceramics and the like can be appropriately used. Various elastomer materials and rubber materials are preferably used from the viewpoint of processing characteristics and the like. Specific examples thereof include fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, a copolymer of ethylene/propylene/butadiene, and nitrile butadiene rubber. In particular, silicone rubber, fluorosilicone rubber, and phenyl silicone rubber are preferable in terms of dimensional stability and the durability because of small compression set. In addition, the change in the elastic modulus due to temperature is small, which is also preferable from the viewpoint of transferability.

Various adhesives or double-sided tapes may be used between the layers constituting the transfer body (the surface layer, the elastic layer, and the compressible layer) in order to fix and hold the layers. A reinforcing layer having a high compressive elastic modulus may be provided for suppressing lateral elongation when being mounted on the device and for maintaining elasticity. Further, the woven fabric may be used as a reinforcing layer. The transfer body can be produced by optionally combining each layer by the above-described material.

The size of the transfer body can be freely selected according to the size of the target print image. The shape of the transfer body is not particularly limited, and specifically, examples thereof include a sheet shape, a roller shape, a belt shape, and an endless web shape.

[Support Member]

The transfer body 101 is supported on the support member 102. As a method of supporting the transfer body, various adhesives or double-sided tapes may be used. Alternatively, by attaching a mounting member made of a material such as metal, ceramic, and a resin to the transfer body, the transfer body may be supported on the support member 102 using the mounting member.

The support member 102 is required to have a certain degree of structural strength from the viewpoint of conveying accuracy and durability. For the material of the support member, metal, ceramic, resin or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics, alumina ceramics are preferably used. Further, these are preferably used in combination.

[Reaction Liquid Applying Device]

The ink jet printing apparatus of the present embodiment includes the reaction liquid applying device 103 for applying the reaction liquid to the transfer body 101. The reaction liquid applying device 103 illustrated in FIG. 1 indicates a gravure offset roller which is provided with a reaction liquid storing unit 103*a* for storing the reaction liquid and reaction liquid applying members 103*b* and 103*c* for applying the reaction liquid in the reaction liquid storing unit 103*a* onto the transfer body 101.

[Ink Applying Device]

The ink jet printing apparatus of the present embodiment includes an ink applying device 104 that applies ink to the transfer body 101 to which the reaction liquid is applied. The first image is formed by mixing the reaction liquid and the ink, and in the subsequent liquid absorbing device 105, the liquid component is absorbed from the first image.

[Liquid Absorbing Device]

In this embodiment, the liquid absorbing device 105 includes the liquid absorbing member 105*a*, and a pressing member 105*b* for liquid absorption which presses the liquid absorbing member 105*a* against the first image on the transfer body 101. It is possible to perform a liquid absorption treatment from the first image by allowing the first image to pass through a nip portion formed when the first surface of the porous body is brought into contact with the outer peripheral surface of the transfer body 101 by operating the pressing member 105*b* to press the second surface of the liquid absorbing member 105*a*. Here, a region where the liquid absorbing member 105*a* can be pressed and brought into contact with the outer peripheral surface of the transfer body 101 is set as a liquid absorption treatment region.

The position of the pressing member 105*b* with respect to the transfer body 101 can be adjusted by a position control mechanism (not shown). For example, the liquid absorbing member 105*a* can be configured to be reciprocatable in the direction of an arrow B indicated in FIG. 1 so as to be brought into contact with or separated from the outer peripheral surface of the transfer body 101 at the timing when the liquid absorption treatment is required.

Note that, the shapes of the liquid absorbing member 105*a* and pressing member 105*b* are not particularly limited. For example, as illustrated in FIG. 1, a configuration in which the pressing member 105*b* has a columnar shape, the liquid absorbing member 105*a* has a belt shape, and the liquid absorbing member 105*a* having the belt shape is pressed against the transfer body 101 by the pressing member 105*b* having the columnar shape may be employed. In addition, a configuration in which the pressing member 105*b* has a columnar shape, the liquid absorbing member 105*a* has a cylindrical shape formed on the peripheral surface of the pressing member 105*b* having the columnar shape, and the liquid absorbing member 105*a* having the cylindrical shape is pressed against the transfer body by the pressing member 105*b* having the columnar shape may be employed.

In the present invention, it is preferable that the liquid absorbing member 105*a* has the belt shape in consideration of the space and the like in the ink jet printing apparatus. In addition, the liquid absorbing device 105 which includes the liquid absorbing member 105*a* having such a belt shape may include an extending member for extending the liquid absorbing member 105*a*. In FIG. 1, reference numerals 105*c*, 105*d* and 105*e* represent an extending roller as the extending member. These extending rollers and the belt-shaped liquid absorbing member 105*a* extended around the extending rollers constitute a liquid absorbing member conveyance device that conveys the liquid absorbing member for performing the liquid absorption treatment from the first image. With this conveyance device, it is possible to carry in, carry out and retransmit the liquid absorbing member to the liquid absorption treatment region. Note that, in FIG. 1, the pressing member 105*b* is also a roller member that rotates similarly to the extending roller, but the present invention is not limited thereto.

In a case where the extending roller abuts on the surface of the liquid absorbing member 105*a* which is brought into contact with the first image, it is preferable to make the material of the extending roller slippery or soft, and a fluororesin or the like is preferable. It is also preferable to change the surface material of the extending roller abutting on the surface brought into contact with the first image from the surface material of the extending roller abutting on the opposite surface.

In the liquid absorbing device 105, when the liquid absorbing member 105*a* including the porous body is pressed to the first image by the pressing member 105*b*, the second image is obtained by absorbing at least a portion of the liquid component included in the first image to the liquid absorbing member 105*a*, and decreasing the liquid component from the first image. As a method of decreasing the liquid components from the first image, in addition to the present method of pressing the liquid absorbing member, other various conventionally used methods, for example, a method of heating, a method of blowing low humidity air, and a method of reducing pressure may be used in combination. Alternatively, these methods may be applied to the second image with decreased liquid component to further decrease the liquid component.

Hereinafter, various conditions and configurations in the liquid absorbing device 105 will be described in detail.

(Pressurizing Condition)

When the pressure of the liquid absorbing member pressing against the first image on the transfer body is equal to or greater than 2.9 N/cm$^2$ (0.3 kgf/cm$^2$), the liquid component in the first image can be solid-liquid separated in a shorter time period, and the liquid component can be removed from the first image, which is preferable. Note that, in the present specification, the pressure of the liquid absorbing member indicates a nip pressure between the ink receiving medium, and the liquid absorbing member, and the value of the pressure is calculated by performing surface pressure measurement by using a surface pressure distribution measuring device (I-SCAN, manufactured by NITTA Corporation) and dividing the weight in the pressurized region by the area.

(Application Time)

It is preferable that the application time of bringing the liquid absorbing member 105*a* into contact with the first image is within 50 ms (milliseconds) in order to further suppress the adhesion of the coloring material in the first image to the liquid absorbing member. Incidentally, the application time in the present specification is calculated by dividing a pressure sensing width in the moving direction of the ink receiving medium in the above-described surface pressure measurement by the moving speed of the ink receiving medium. Hereinafter, this application time is referred to as a liquid absorbing nip time.

In this way, on the transfer body 101, the liquid component is absorbed from the first image and a second image with reduced liquid content is formed. The second image is then transferred onto the printing medium 108 at the transfer unit.

(Pretreatment)

The liquid absorbing device 105 can be provided with a pretreatment liquid applying device including a pretreatment liquid applying unit as necessary. In the present embodiment, a pretreatment is preferably performed by the pretreatment liquid applying device (not shown in FIGS. 1 and 2) for applying a wetting liquid (the third liquid) to the liquid absorbing member before bringing the liquid absorbing member 105*a* having the porous body into contact with the first image.

The wetting liquid is not particularly limited as long as it has a contact angle with the first surface of the porous body of less than 90° and is capable of imparting a target liquid absorbability to the porous body. The aqueous liquid medium (water-soluble liquid), for example, water, or a mixture of water and a water-soluble organic solvent may be contained and a surfactant can be added and used for suitably adjusting its surface tension. The material used for preparing the wetting liquid is not particularly limited, but it is preferable to use a surfactant. As the surfactant, it is preferable to use at least one of a silicone-based surfactant and a fluorine-based surfactant. The wetting liquid preferably contains water and a water-soluble organic solvent. Water is preferably deionized water by ion exchange or the like. Further, the kinds of the water-soluble organic solvents are not particularly limited, and any of known organic solvents such as ethanol and isopropyl alcohol can be used. In the pretreatment of the liquid absorbing member, the method of applying the wetting liquid is not particularly limited, and immersion and liquid droplet dripping are preferable.

A pretreatment liquid applying step is preferably performed before the liquid absorbing step, and is more preferably performed between the liquid collecting step and the liquid absorbing step.

[Initializing and Cleaning of Liquid Absorbing Member]

Figure 6:
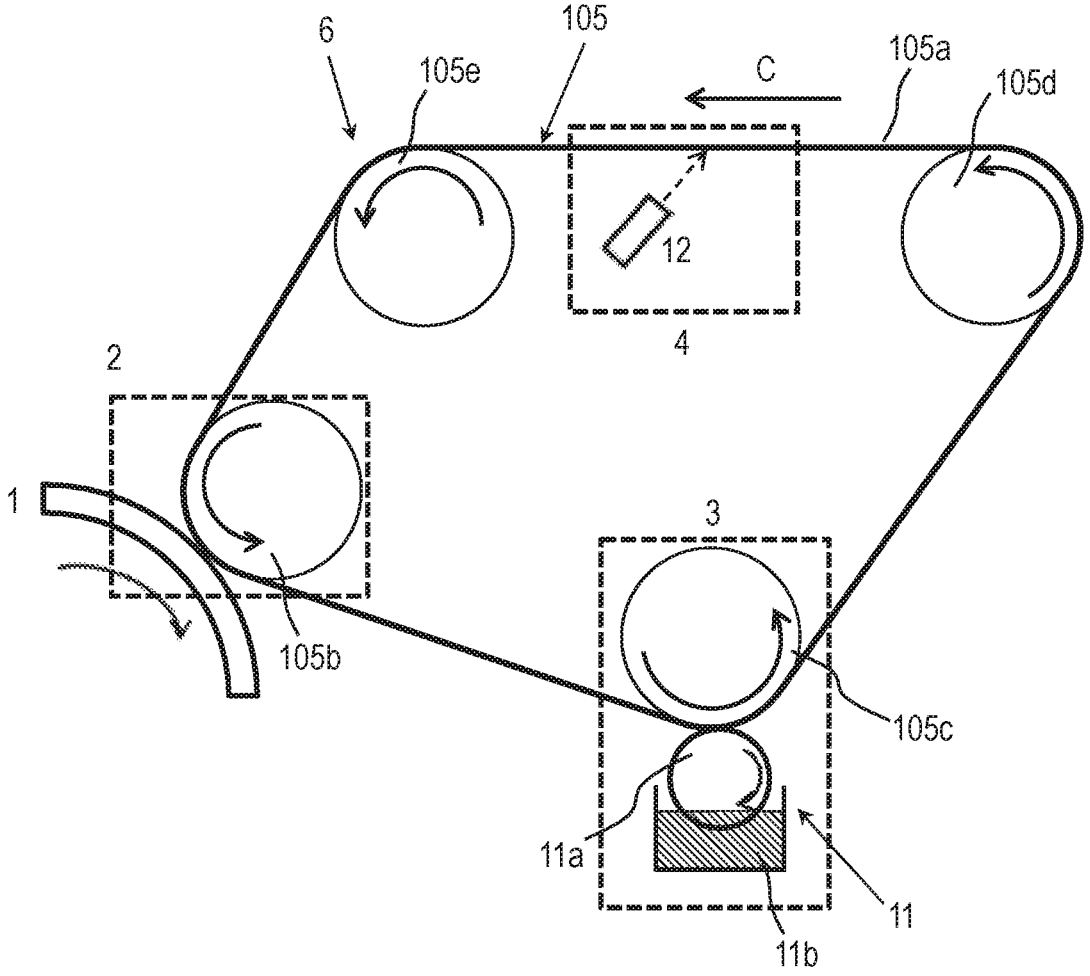
FIG. 6 is a schematic view in which a plurality of steps of enlarging a liquid absorbing device and initializing a liquid absorbing member after liquid absorption are arranged in the transfer type ink jet printing apparatus illustrated in FIG. 1.

In order to enable continuous printing by repeatedly using the liquid absorbing member 105*a* including the porous body, a step of initializing the liquid absorbing member by removing dirt attached to the surface of the porous body, or removing the liquid absorbed by the porous body is required. FIG. 6 is an enlarged schematic view of the liquid absorbing device 105 in the transfer type ink jet printing apparatus illustrated in FIG. 1. In addition, a plurality of steps for initializing the porous body absorbing the liquid is illustrated. Hereinafter, each step for initializing the porous body will be described with reference to FIG. 6.

As illustrated in FIG. 6, the liquid absorbing device 105 is provided with a liquid absorbing member conveyance device 6 formed of the liquid absorbing member 105*a* including the porous body and the extending members 105*c*, 105*d* and 105*e* that extend the liquid absorbing member 105*a*. The liquid absorbing member 105*a* is conveyed in the direction of an arrow C by the liquid absorbing member conveyance device 6. On the conveyance path of the liquid absorbing member 105*a*, a liquid absorbing unit 2 that performs liquid absorption by pressing the liquid absorbing member 105*a* to the first image (not shown) on the transfer body 1 by the pressing member 105*b*, a recovery liquid applying unit 3 that applies a recovery liquid to the liquid absorbing member 105*a* after absorbing the liquid component from the first image by the recovery liquid applying device 11 and a liquid collecting unit 4 that collects the liquid component absorbed by the liquid absorbing member 105*a* by a liquid collecting device 12 are arranged in this order. As the liquid absorbing member is repeatedly conveyed in the conveyance path, the liquid absorbing member is repeatedly subjected to the liquid absorbing step, the recovery liquid applying step and the liquid collecting step. Hereinafter, a step of performing the liquid absorption in the liquid absorbing unit 2 is referred to as a liquid absorbing step 2, a step of applying the recovery liquid in the recovery liquid applying unit 3 is referred to as a recovery liquid applying step 3 and a step of performing liquid collection in the liquid collecting unit 4 is referred to as a liquid collecting step 4.

Specifically, with a reaction liquid applying device 103 and an ink applying device 104 (which are not shown in FIG. 6), the application of the reaction liquid and ink discharge from a printing head are performed in this order with respect to the transfer body 1 that rotates in a clockwise direction, and the reaction liquid and the ink aggregate on the surface of the transfer body 1 so as to form an aggregation (first image). The liquid absorbing member (for example, the endless porous belt) 105*a* rotates in the counterclockwise direction, and is brought into contact with the above-described aggregation in a liquid absorption treatment region so as to form a nip portion, and passes through a liquid absorbing step 2 which performs the absorption of excess liquid from the aggregation. Next, in order to prevent the liquid absorbed by the liquid absorbing member form being thickened, and to make the liquid distribution inside the liquid absorbing member uniform, the recovery liquid is applied in the recovery liquid applying step 3. In the recovery liquid applying step 3, a reference numeral 11*b* is a chamber for holding the recovery liquid, and pumps up the recovery liquid in the chamber to the surface of an adhesive rubber roller 13*a* so as to apply the recovery liquid to the surface of the liquid absorbing member.

In order to perform the liquid absorption from the first image by repeatedly using the porous body, it is necessary to secure a vacant volume in the porous body before the porous body is brought into contact with the first image. Therefore, as a step subsequent to the collection liquid applying step 3, a liquid collecting step 4 of removing or collecting the liquid, which is once absorbed by the liquid absorbing member, by the liquid collecting device 12 is performed. On the other hand, in the transfer body 1 that has passed through the liquid absorbing step 2, the ink in a state in which excess liquid has been removed remains, and in the subsequent transfer process, the ink is transferred to the printing medium.

In this way, as the liquid absorbing member 105*a* is repeatedly conveyed in the conveyance path by the liquid absorbing member conveyance device, the liquid absorbing member is repeatedly subjected to the liquid absorbing step, the recovery liquid applying step and the liquid collecting step in this order. As a result, before the liquid absorbing member 105*a* which has once undergone the liquid absorbing step is conveyed again to the liquid absorption treatment region, and is subjected to the liquid absorbing step again, the liquid component contained in the liquid absorbing member can be collected, and even in a case where the liquid absorbing member is repeatedly used, it is possible to suppress a decrease in the liquid absorption performance of the liquid absorbing member.

However, as will be described later, the inventors of the present invention have found that when the above-described liquid absorbing member initializing steps: liquid absorbing step 2→recovery liquid applying step 3→liquid collecting step 4 is repeatedly performed so as to attempt continuous printing, at the timing of 20th liquid absorbing step 2, dirt attached to the surface of the liquid absorbing member rotates around the conveyance path once while remaining during recovery liquid applying step 3→liquid collecting step 4, and the dirt is moved to the first image on the transfer body in the subsequent liquid absorbing step 2, and thereby an image defect occurs in a printed image after transfer. This image defect is a phenomenon in which, for example, those like cyan color spots are scattered in a yellow color image when the yellow color image is printed after printing a cyan color image.

It is considered that this is because when the liquid absorbing step is performed on the cyan image printed on the transfer body first by using the liquid absorbing member, due to the absorption of excess liquid components, even a slight amount of the coloring material which is a solid component contained in the ink is also moved to the surface of the liquid absorbing member, and as a result, the coloring material having the cyan color is moved to the yellow color solid image of the transfer body at the timing of the liquid absorbing step of the yellow color image printed later on the transfer body.

Therefore, the ink jet printing apparatus according to the present invention further includes a cleaning unit that removes dirt derived from ink or the like attached to the porous body with a cleaning member. However, as a result of the study by the inventors of the present invention, it was found that the cleaning step of removing dirt by allowing the cleaning member to abut on the porous body is not always sufficiently effective even in a case of being disposed in any position in the conveyance path of the liquid absorbing member, and there is a difference in the effect of the cleaning performance of the porous body depending on the order of the other initializing steps of porous bodies such as the recovery liquid applying step and the liquid collecting step.

Figure 7:
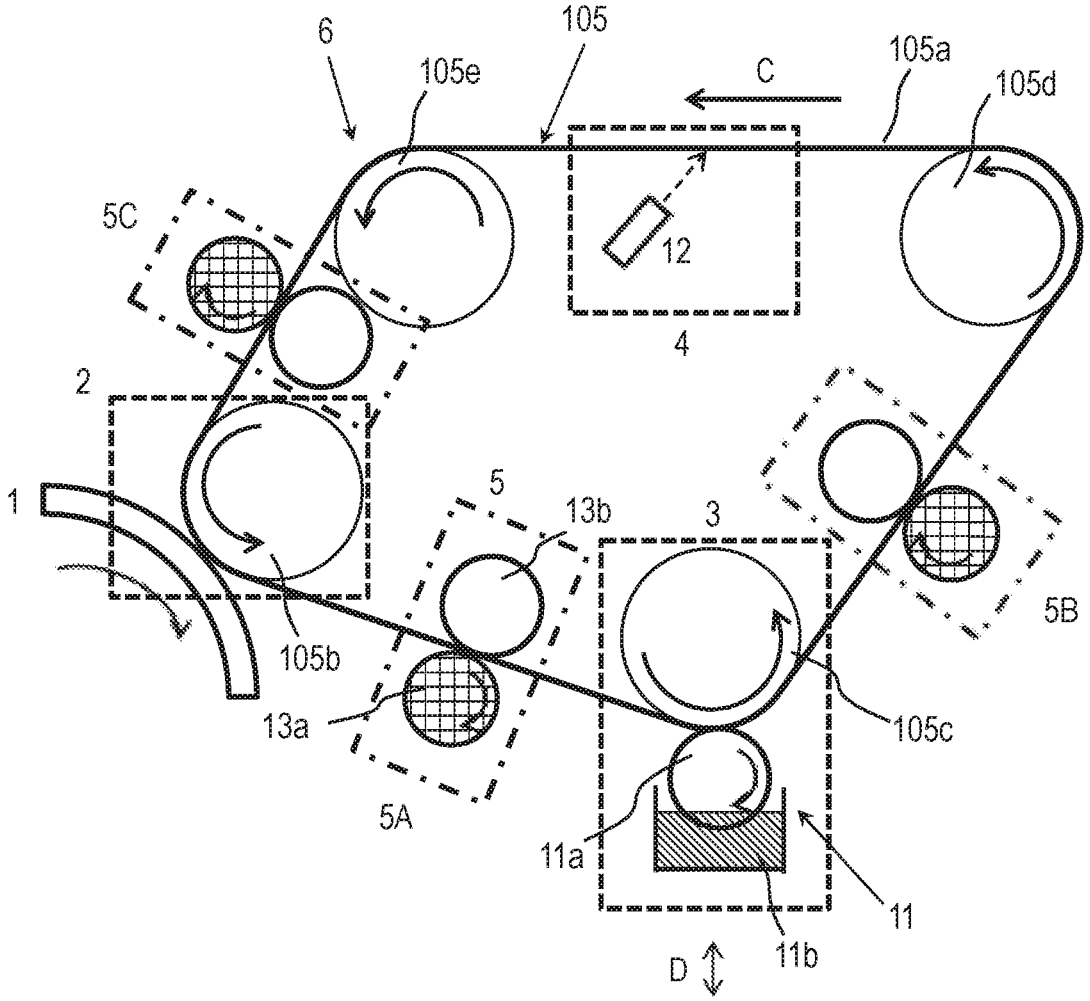
FIG. 7 is a schematic diagram in which one cleaning step is disposed for a plurality of initializing steps of the liquid absorbing member illustrated in FIG. 6.

Specifically, as illustrated in FIG. 7, in a case where the cleaning step 5 is performed at any stage of initializing steps of the porous body: liquid absorbing step 2→recovery liquid applying step 3→liquid collecting step 4, as a position where the cleaning step is performed, three positions of a position between the liquid absorbing step 2 and the recovery liquid applying step 3 (position 5A), a position between the recovery liquid applying step 3 and the liquid collecting step 4 (position 5B) and a position between the liquid collecting step 4 and the liquid absorbing step 2 (position 5C) are assumed. Among them, the cleaning step is preferably performed in at least the position between the liquid absorbing step 2 and the recovery liquid applying step 3 (position 5A) or the position between the liquid collecting step 4 and the liquid absorbing step 2 (position 5C). That is, it is preferable that the cleaning unit is disposed at least between the liquid absorbing unit and the recovery liquid applying unit or between the liquid collecting unit and the liquid absorbing unit.

Note that, in the conveyance path of the liquid absorbing member, the extending rollers and the like other than various rollers used in the above steps may be arranged. Hereinafter, the liquid absorbing unit, the liquid collecting unit and the cleaning unit will be described in detail.

(Liquid Absorbing Unit)

In the liquid absorbing unit 2, the above-described liquid absorbing member 105*a* including the porous body is pressed to the first image by the pressing member 105*b* so as to perform absorption of the first liquid from the first image.

(Recovery Liquid Applying Unit)

In the recovery liquid applying unit 3, until the porous body included in the liquid absorbing member 105*a* is repeatedly brought into contact with the first image, the recovery liquid having a viscosity lower than that of the ink or/and the reaction liquid is applied to the liquid absorbing member 105*a* by using the recovery liquid applying device. In a case of repeatedly using the liquid absorbing member, by applying the recovery liquid to the liquid absorbing member 105*a* after the liquid absorbing step 2 and before the liquid collecting step 4, it is possible to prevent the liquid component in the porous body from being thickened and to make the liquid distribution in the porous body uniform. FIG. 7 illustrates a recovery liquid applying device 11 constituting the recovery liquid applying unit with a recovery liquid applying member 11*a*, a chamber 11*b* holding the recovery liquid and an extending roller 105*c* in combination.

The recovery liquid can be prepared with water as a main component, and is not particularly limited as long as the liquid viscosity is lower than that of the ink and/or the reaction liquid and is colorless and transparent. It is also possible to use only water as a recovery liquid. Water is preferably deionized water by ion exchange or the like. The recovery liquid may further contain a water-soluble organic solvent as long as the effect of the present invention can be obtained. The kinds of the water-soluble organic solvents are not particularly limited, and any of known organic solvents such as ethanol and isopropyl alcohol can be used. It may also contain a surfactant. Specific examples of the surfactant include Acetylenol E100 (manufactured by Kawaken Fine Chemicals Co., Ltd.) and the like.

Further, for example, a rubber roller can be used as the recovery liquid applying member 11*a* for pumping up and applying the recovery liquid to the porous body. The material of the rubber can be suitably selected from known materials depending on the liquid amount and viscosity of the recovery liquid. This also applies to the surface roughness of rubber. Examples of the rubber used for the rubber roller include nitrile rubber (NBR).

The recovery liquid can also be prepared by a method of adjusting the viscosity to a predetermined value by using a component obtained by removing the coloring material from the components of the ink. In this case, the various materials described in the sections of "(Water and water-soluble organic solvent)" and "(Other additives)" relating to the ink can be used. The recovery liquid has a viscosity lower than that of the ink and/or the reaction liquid. When the recovery liquid has the low viscosity, the viscosity of the liquid after the application of the recovery liquid is easily lowered, and the liquid inside the porous body can be uniformly distributed. As a result, it is possible to efficiently collect the liquid from the porous body. Note that, the viscosity of the ink, the reaction liquid and the recovery liquid in the present invention is the viscosity before drying. The viscosity of the recovery liquid is preferably 2.0 cP or more lower than that of the ink and the reaction liquid.

Further, it is preferable that the recovery liquid has a moisture concentration higher than that of the ink and the reaction liquid. When the recovery liquid has the high moisture concentration, the rate of substitution between a residual solvent inside an absorber and the applied recovery liquid at the time of applying the recovery liquid is increased. It is also preferable that the recovery liquid has a vapor pressure lower than that of the reaction liquid and the ink. In a case where the recovery liquid applied to the inside of the absorber is difficult to evaporate, the liquid component is hard to be thickened, and thereby it is possible to suppress the amount of recovery liquid used. Examples of the organic solvent that lowers the vapor pressure include ethylene glycol monoethyl ether and ethylene glycol monomethyl ether.

As to the timing of applying the recovery liquid, the recovery liquid may be applied each time, and it is also possible to intermittently apply the recovery liquid in a range where problems such as air venting do not occur in the liquid collecting step. When intermittently applying the recovery liquid, it is possible to suppress the amount of recovery liquid used. At the time of intermittently applying the recovery liquid, the recovery liquid applying device 11 is preferably separated from the liquid absorbing member 105*a* by a device (not shown) which makes the recovery liquid applying device 11 separated from the liquid absorbing member 105*a*. For example, it is possible to install the recovery liquid applying device such that an operation of moving the recovery liquid applying device 11 to a position where the recovery liquid is applied to the liquid absorbing member 105*a* and an operation of separating the recovery liquid applying device 11 from the liquid absorbing member 105*a*, that is, a reciprocal movement in the direction of an arrow D illustrated in FIG. 7 can be performed at the time of being needed. This reciprocating operation can be performed by a configuration in which the recovery liquid applying device is disposed at a lifting stage (not shown) that can be raised and lowered by a lifting air cylinder (not shown).

Note that, as the recovery liquid, it is preferable to use the same liquid as the wetting liquid used for the pretreatment of the liquid absorbing member 105*a* described above in order to simplify the device. It is also preferable that the recovery liquid applying device also serves as a pretreatment liquid applying device. Therefore, in the present invention, the pretreatment step can be omitted by performing the recovery liquid applying step. In this case, as the recovery liquid, a liquid which simultaneously satisfies the requirements of the recovery liquid and the wetting liquid is used. Specifically, the recovery liquid can also serve as a wetting liquid by using a liquid having a viscosity lower than that of the ink and/or the reaction liquid and having a contact angle with the first surface of the porous body of less than 90°. With such a configuration, the device can be simplified and the cost can be reduced.

(Liquid Collecting Unit)

In the liquid collecting unit 4, the liquid component absorbed by the porous body (liquid absorbing member 105*a*) is collected by the liquid collecting device 12. The liquid component can be collected from the porous body 105*a* by known means. Examples thereof include a method of heating, a method of blowing low humidity air, a method of reducing pressure and a method of squeezing the porous body. In FIG. 6, a reference numeral 12 represents an air blow type nozzle, and a method of scattering the liquid held in the porous body by spraying air from the nozzle 12 to the second surface which is the back side of the first surface which is a contact surface between the porous body and the first image is illustrated. As another method, it is also possible to use a method of bringing a cap or the like causing a negative pressure into contact with the porous body so as to remove or collect the liquid once absorbed by the porous body.

(Cleaning Unit)

In the cleaning unit 5, the cleaning member is brought into contact with the first surface of the porous body such that dirt derived from the ink or the like attached to the first surface is removed by the cleaning member. As described above, the cleaning unit is disposed at least between the liquid absorbing unit and the recovery liquid applying unit (5A) or between the liquid collecting unit and the liquid absorbing unit (5C). As the kind of dirt attached to the porous body, solid component dirt of a coloring material and an emulsion resin contained in the ink as described above, and fiber dirt such as dust and paper powder and the like are assumed. As a result of investigations by the inventors of the present invention, it was found that in most cases of the actual use form of the ink jet printing apparatus, all of the above described kinds of dirt are attached to the surface of the porous body at the timing of the liquid absorbing step. Further, in the present invention, it was found that the cleaning performance varies depending on the timing of performing the cleaning step, and that the parameters affecting the cleaning performance are different depending on the kind of attached dirt. Details will be described in examples.

Note that, even in a case where the kind of dirt attached to the porous body cannot be limited, when the cleaning step 5 is disposed at least between the liquid absorbing unit and the recovery liquid applying unit or between the liquid collecting unit and the liquid absorbing unit, the effect of the present invention can be further obtained.

When the porous body with ink-derived aggregation dirt enters the recovery liquid applying unit, the ink coloring material component is gradually dissolved into a chamber for holding the recovery liquid, which may increase an exchange frequency of the recovery liquid. Therefore, installing the cleaning unit at 5A is effective for reduction of the exchange frequency of the recovery liquid and load reduction of a filter of the path for supplying and discarding the recovery liquid.

As the cleaning member, a rubber roller having adhesiveness can be used. At that time, since the outermost layer of the porous body has a small thickness so as to satisfy the liquid absorption performance and has weak mechanical strength, the cleaning step is performed in a range of the level at which the structure of the outermost layer is not destroyed by abutting on or being separated from the adhesive rubber roller. The material of the adhesive rubber roller is not particularly limited, and any known material can be used. For example, rubber materials such as butyl, silicone, urethane and the like can be mentioned.

Two or more cleaning units may be included in the conveyance path of the liquid absorbing member. That is, the cleaning step may be performed two or more times in the conveyance path. Even in such a case, one cleaning unit is disposed at least between the liquid absorbing unit and the recovery liquid applying unit or between the liquid collecting unit and the liquid absorbing unit.

The cleaning member included in the cleaning unit disposed between the liquid absorbing unit and the recovery liquid applying unit is preferably a hard material in order to efficiently remove the ink aggregation attached to the porous body and efficiently perform secondary cleaning on the ink aggregation attached to the cleaning member by using a secondary cleaning member such as a blade (secondary cleaning step). The secondary cleaning member is disposed being in contact with the cleaning member.

On the other hand, the cleaning member included in the cleaning unit disposed between the liquid collecting unit and the liquid absorbing unit removes attached dirt while the liquid absorbing member 105*a* is being conveyed. In a case where the amount of attached dirt is small, it is preferable to perform the secondary cleaning of the cleaning member offline. In addition, it is preferable to intermittently perform the cleaning step. Further, a soft material is preferably used as the cleaning member included in the cleaning unit disposed between the liquid collecting unit and the liquid absorbing unit, as compared with a case of being disposed between the liquid absorbing unit and the recovery liquid applying unit. Note that, the hardness can be indicated by compressive elastic modulus, and indicates a value measured by a known method.

Examples of a method of bringing the cleaning member into contact with the first surface of the porous body include a method of disposing a back-up roller on the second surface of the porous body, sandwiching the porous body between the backup rollers, and then bringing the adhesive rubber roller into contact with the first surface of the porous body.

(Pressing Member for Transferring)

In the present embodiment, while the second image and the printing medium 108 conveyed by the conveyance device 107 for the printing medium are in contact with each other, the pressing member 106 for transferring presses the printing medium 108, and thereby an image (ink image) is transferred onto the printing medium 108. When removing the liquid component contained in the first image on the transfer body 101, and then transferring it onto the printing medium 108, it is possible to obtain a printed image in which curling, cockling and the like are suppressed.

The pressing member 106 is required to have a certain degree of structural strength from the viewpoint of conveying accuracy and durability of the printing medium 108. For the material of the pressing member 106, metal, ceramic, resin or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics, alumina ceramics are preferably used. Further, these may be used in combination. The shape of the pressing member 106 is not particularly limited, but for example, a roller shape can be mentioned.

The pressing time of the pressing member 106 for transferring the second image on the transfer body 101 onto the printing medium 108 is not particularly limited, and in order not to impair the transferability and the durability of the transfer body, it is preferably 5 ms or longer to 100 ms or shorter. In the present embodiment, the pressurizing time indicates the time during which the printing medium 108 and the transfer body 101 are in contact with each other, and the value of the time was calculated by performing the surface pressure measurement by using the surface pressure distribution measuring device (I-SCAN, manufactured by NITTA Corporation) and dividing the length in the conveying direction of the pressure region by the conveying speed.

The pressure pressed by the pressing member 106 for transferring the second image on the transfer body 101 onto the printing medium 108 is also not particularly limited as long as the transfer is performed well and the durability of the transfer body is not impaired. Therefore, it is preferable that the pressure is 9.8 $N/cm^2$ (1 $kgf/cm^2$) or more to 294.2 $N/cm^2$ (30 $kgf/cm^2$) or less. Incidentally, the pressure in the present embodiment indicates the nip pressure between the printing medium 108 and the transfer body 101, and the value of the pressure is calculated by performing the surface pressure measurement by the surface pressure distribution measuring device and dividing the load in the pressure region by the area.

The temperature at which the pressing member 106 presses for transferring the second image on the transfer body 101 onto the printing medium 108 is also not particularly limited, and it is preferably equal to or higher than a glass transition point or equal to or higher than a softening point of a resin component contained in the ink. For heating, it is preferable to provide heating device for heating a second image on the transfer body 101, the transfer body 101 and the printing medium 108.

(Printing Medium and Conveyance Device for Printing Medium)

In the present embodiment, the printing medium 108 is not particularly limited, and any of known printing media can be used. As the printing medium, a long object wound in a roll shape or a sheet material cut into a predetermined size can be exemplified. Examples of the materials include paper, a plastic film, a wood board, a cardboard and a metal film.

In FIG. 1, the conveyance device 107 for printing medium for conveying the printing medium 108 is constituted by a feeding roller 107*a* for printing medium and a winding roller 107*b* for printing medium, but it is not particularly limited thereto as long as the printing medium can be conveyed.

(Control System)

Figure 3:
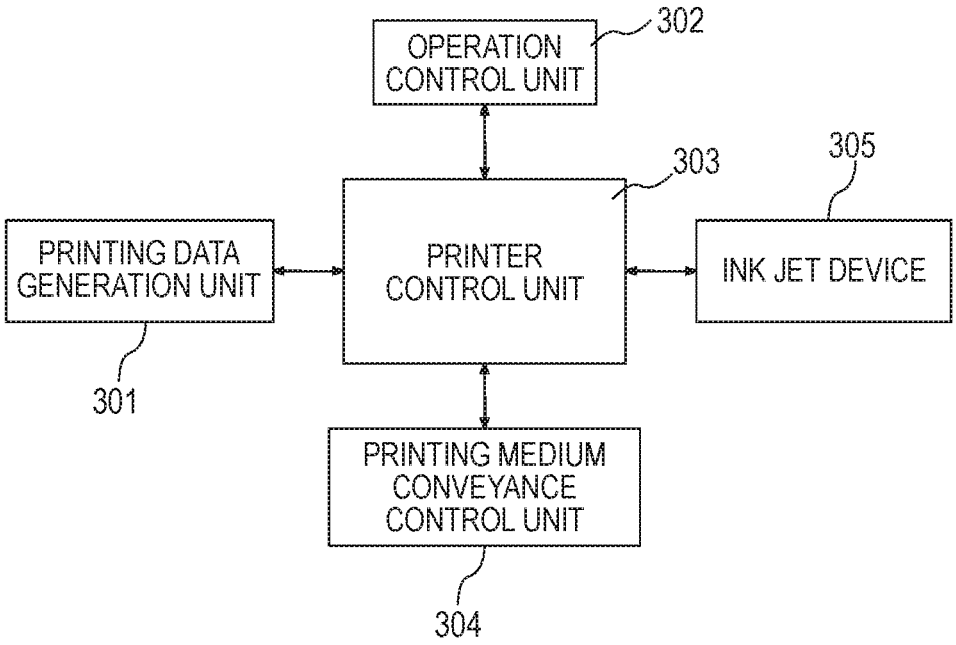
FIG. 3 is a block diagram illustrating a control system of the entire apparatus in the ink jet printing apparatus illustrated in FIGS. 1 and 2.

The transfer-type ink jet printing apparatus in the present embodiment has a control system for controlling each device. FIG. 3 is a block diagram illustrating a control system of the entire apparatus in the transfer type ink jet printing apparatus illustrated in FIG. 1. In FIG. 3, a reference numeral 301 represents a printing data generation unit such as an external print server, a reference numeral 302 represents an operation control unit such as an operation panel, a reference numeral 303 represents a printer control unit for executing a printing process, a reference numeral 304 represents a printing medium conveyance control unit for conveying the printing medium and a reference numeral 305 represents an ink jet device for printing.

Figure 4:
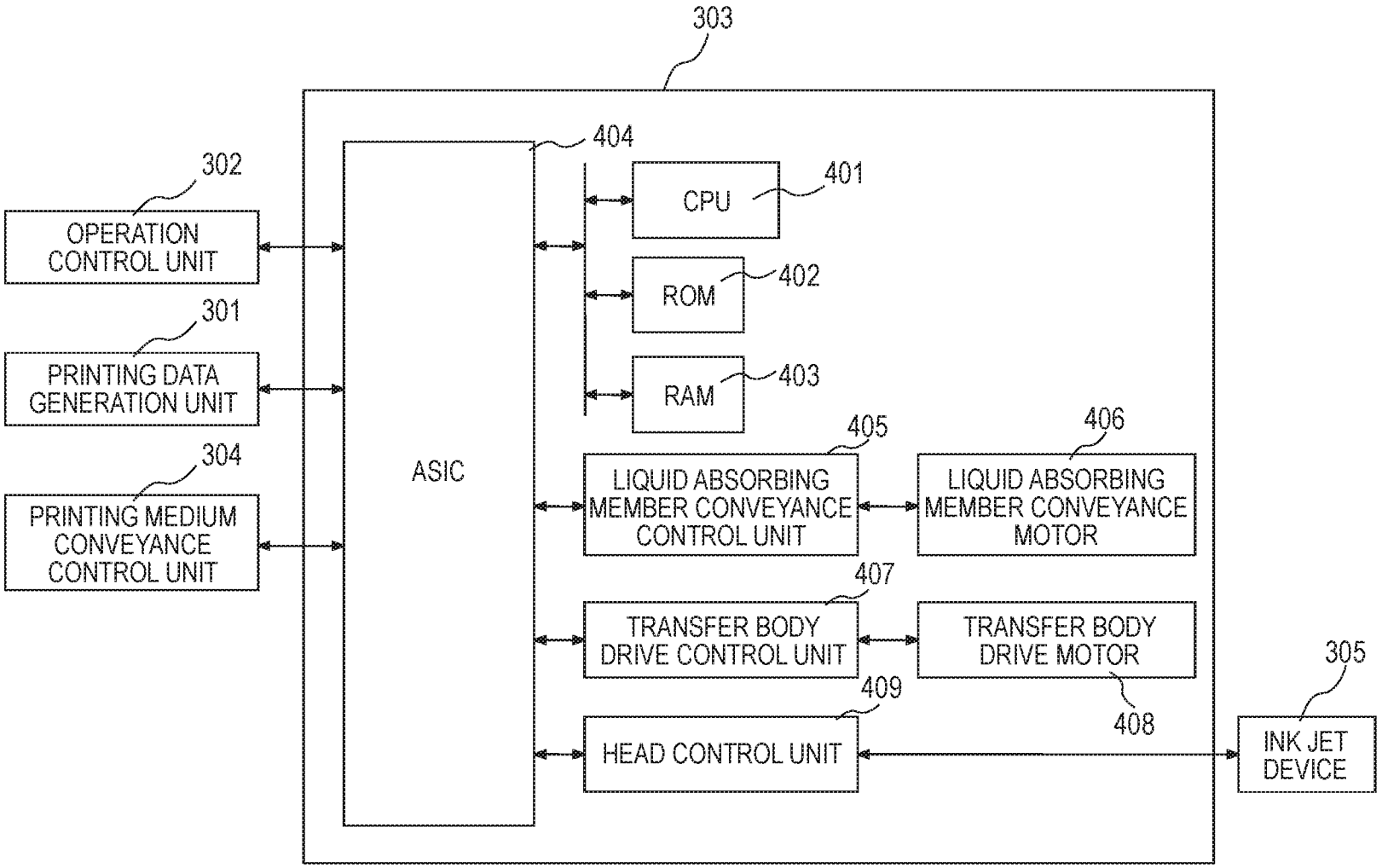
FIG. 4 is a block diagram of a printer control unit in the transfer type ink jet printing apparatus illustrated in FIG. 1.

FIG. 4 is a block diagram of a printer control unit in the transfer type ink jet printing apparatus illustrated in FIG. 1. A reference numeral 401 represents a CPU for controlling the entire printer, a reference numeral 402 represents a ROM for storing a control program of the CPU and a reference numeral 403 represents a RAM for executing the program. A reference numeral 404 represents an application specific integrated circuit (ASIC) including a network controller, a serial IF controller, a controller for generating head data, a motor controller and the like. A reference numeral 405 represents a liquid absorbing member conveyance control unit for driving a liquid absorbing member conveyance motor 406, and the liquid absorbing member conveyance control unit for 405 is controlled by a command from the ASIC 404 via the serial IF. A reference numeral 407 represents a driving control unit for transfer body that drives a driving motor 408 for transfer body, and similarly, the driving control unit 407 for transfer body is controlled by a command from the ASIC 404 via the serial IF. A reference numeral 409 represents a head control unit which performs final discharge data generation, drive voltage generation and the like of the ink jet device 305.

<Direct Drawing Type Ink Jet Printing Apparatus>

As another embodiment of the present invention, a direct drawing type ink jet printing apparatus can be mentioned. In the direct drawing type ink jet printing apparatus, the ink receiving medium is a printing medium on which an image is to be formed, that is, a printing medium on which a final image as a target is to be formed.

Figure 2:
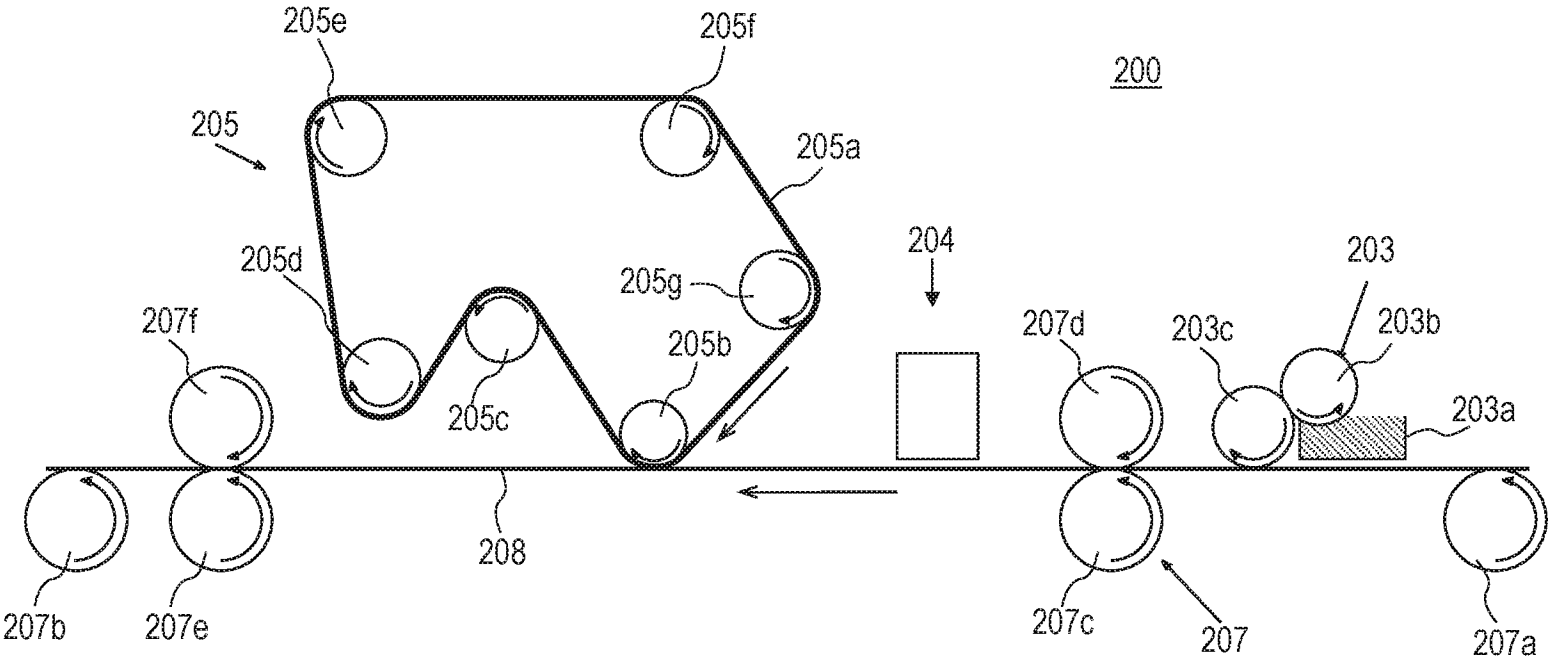
FIG. 2 is a schematic diagram illustrating one example of a configuration of a direct drawing type ink jet printing apparatus in one embodiment according to the present invention.

FIG. 2 is a schematic diagram illustrating one example of a schematic configuration of a direct drawing type ink jet printing apparatus 200 of the present embodiment. Compared to the transfer type ink jet printing apparatus described above, the direct drawing type ink jet printing apparatus has members similar to those of the transfer type ink jet printing apparatus except that it does not have the transfer body 101, the support member 102 and a transfer body cleaning member 109, and forms an image on a printing medium 208. Therefore, a reaction liquid applying device 203 for applying the reaction liquid to the printing medium 208, an ink applying device 204 for applying ink to the printing medium 208 and a liquid absorbing device 205 that absorbs the liquid component contained in the first image by a liquid absorbing member 205*a* coming into contact with the first image on the printing medium 208 have the same configuration as that of the transfer type ink jet printing apparatus, and thus explanation thereof will be omitted.

Note that, in the direct drawing type ink jet printing apparatus of the present embodiment, the liquid absorbing device 205 includes the liquid absorbing member 205*a*, and a pressing member 205*b* for liquid absorption which presses the liquid absorbing member 205*a* against the first image on the printing medium 208. The shapes of the liquid absorbing member 205*a* and the pressing member 205*b* are not particularly limited, and it is possible to use the same shapes as the liquid absorbing member and the pressing member that can be used in the transfer type ink jet printing apparatus. In addition, the liquid absorbing device 205 may include an extending member for extending the liquid absorbing member. In FIG. 2, reference numerals 205*c*, 205*d*, 205*e*, 205*f* and 205*g* represent an extending roller as the extending member. The number of the extending rollers is not limited to five as illustrated in FIG. 2, and a necessary number of the extending rollers may be arranged according to the apparatus design. A printing medium support member (not shown) for supporting the printing medium from below may be provided at a position facing an ink applying unit for applying ink to the printing medium 208 by the ink applying device 204 and a liquid component removing unit for bringing the liquid absorbing member 205*a* into contact with the first image on the printing medium to remove the liquid component.

Figure 8:
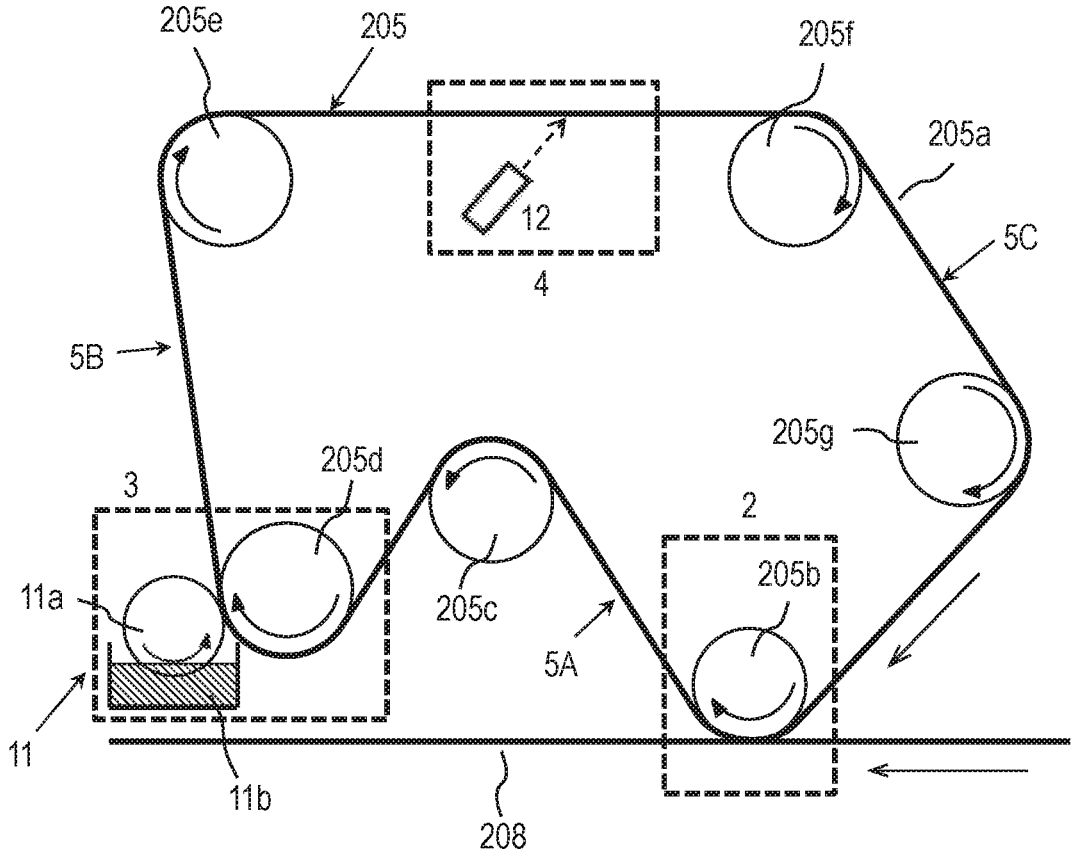
FIG. 8 is a schematic view in which a plurality of steps of enlarging a liquid absorbing device and initializing a liquid absorbing member after liquid absorption are arranged in a direct drawing type ink jet printing apparatus illustrated in FIG. 2.

In addition, in the present embodiment, as in the transfer type ink jet printing apparatus, the liquid absorbing member 205*a* constituting the liquid absorbing device 205 has, as illustrated in FIG. 8, for example, the liquid absorbing unit 2, the recovery liquid applying unit 3 and the liquid collecting unit 4 on the conveyance path in this order. The cleaning unit 5 is disposed at least between the liquid absorbing unit and the recovery liquid applying unit (5A) or between the liquid collecting unit and the liquid absorbing unit (5C). The liquid absorbing member 205*a* is conveyed by the liquid absorbing member conveyance device 6. The liquid absorbing unit 2, the recovery liquid applying unit 3, the liquid collecting unit 4 and the cleaning unit 5 have the same configuration as that of the transfer type ink jet printing apparatus, and the description thereof will not be repeated. FIG. 8 illustrates an example of the arrangement of initializing steps, and as long as those are arranged in a predetermined order in the conveyance path of the liquid absorbing member, each step may be disposed in a position other than the positions illustrated in FIG. 8.

(Conveyance Device for Printing Medium)

In the direct drawing type ink jet printing apparatus of the present embodiment, a conveyance device for printing medium 207 is not particularly limited, and a conveyance device in a known direct drawing type ink jet printing apparatus can be used. Examples thereof include, as illustrated in FIG. 2, a conveyance device for printing medium including a feeding roller 207*a* for printing medium, a winding roller 207*b* for printing medium, and conveyance rollers 207*c*, 207*d*, 207*e* and 207*f* for printing medium.

(Control System)

The direct drawing type ink jet printing apparatus in the present embodiment has a control system for controlling each device. The block diagram illustrating a control system of the entire apparatus in the direct drawing type ink jet printing apparatus illustrated in FIG. 2 is as illustrated in FIG. 3 similar to the transfer type ink jet printing apparatus illustrated in FIG. 1.

Figure 5:
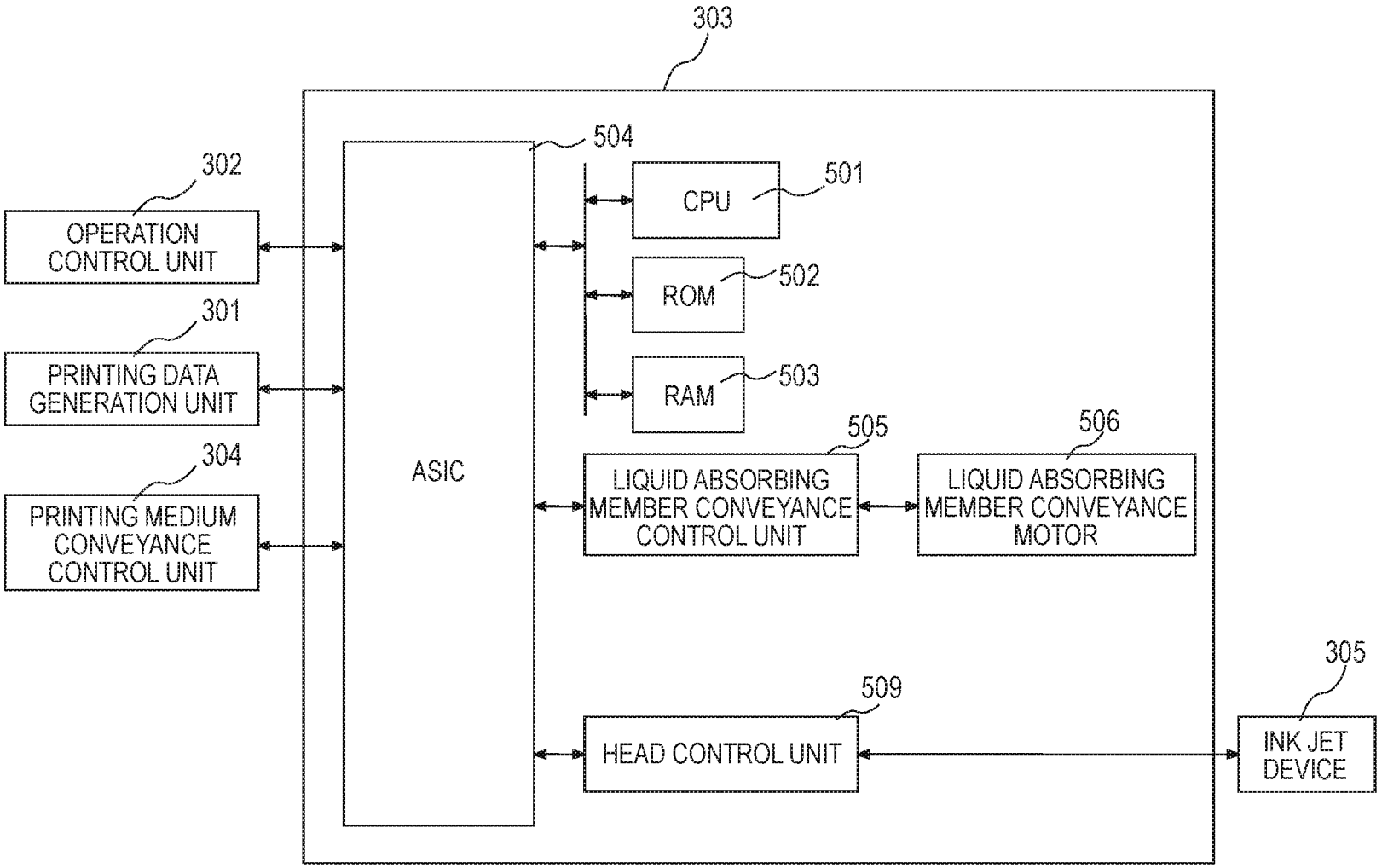
FIG. 5 is a block diagram of a printer control unit in a direct drawing type ink jet printing apparatus illustrated in FIG. 2.

FIG. 5 is a block diagram of a printer control unit in the direct drawing type ink jet printing apparatus illustrated in FIG. 2. Except for not including the driving control unit 407 for transfer body and the driving motor 408 for transfer body, FIG. 5 is the same block diagram as the block diagram of the printer control unit in the transfer type ink jet printing apparatus in FIG. 4. In other words, reference numeral 501 represents a CPU for controlling the entire printer, a reference numeral 502 represents a ROM for storing a control program of the CPU and a reference numeral 503 represents a RAM for executing the program. A reference numeral 504 represents an ASIC including a network controller, a serial IF controller, a controller for generating head data, a motor controller and the like. A reference numeral 505 represents a liquid absorbing member conveyance control unit for driving a liquid absorbing member conveyance motor 506, and the liquid absorbing member conveyance control unit 505 is controlled by a command from the ASIC 504 via the serial IF. A reference numeral 509 represents a head control unit which performs final discharge data generation, drive voltage generation and the like of the ink jet device 305.

Examples

Hereinafter, the present invention will be more specifically described with reference to examples and comparative examples. The present invention is not limited by the following examples without departing from the gist thereof. In the description of the following examples, "part" is on a mass basis unless otherwise specified.

In this example, the transfer type ink jet printing apparatus illustrated in FIG. 1 was used, and as the liquid absorbing device 105, a device illustrated in FIG. 6 was used. As the liquid absorbing member 105*a*, a belt-like liquid absorbing member (porous belt) made of a porous body obtained through lamination by heating the following two layers was used.

First layer: water-repellent PTFE having an average pore diameter of 0.2 μm and a thickness of 10 μm Second layer: Nonwoven fabric made of olefin (produce name: HOP 60, manufactured by Hirose Paper Mfg. Co., Ltd.)

As the recovery liquid, pure water was used, and the recovery liquid held in the chamber 11*b* was pumped up to the surface of the rubber roller as the recovery liquid applying member 11*a* and applied to the surface of the liquid absorbing member. The material of the rubber roller 11*a* was nitrile rubber (NBR). Further, in the examples, in the liquid collecting step 4, the air sprayed from the nozzle 12 is blown onto the second surface of the liquid absorbing member by using the air blow type nozzle 12, and the liquid held by the porous body was removed and collected.

At first, without performing the cleaning step, an operation performing only the above-described initializing steps of liquid absorbing member: liquid absorbing step 2→recovery liquid applying step 3→liquid collecting step 4 was repeatedly performed after the first image was formed on the transfer body for continuous printing. As a result, at the timing of 20th liquid absorbing step 2, dirt attached to the surface of the liquid absorbing member rotated around the conveyance path once while remaining during recovery liquid applying step 3→liquid collecting step 4, and the dirt was moved to the first image on the transfer body in the subsequent liquid absorbing step 2, and thereby an image defect occurred in a printed image after transfer. Specifically, those like cyan color spots were scattered in a yellow color image when the yellow color image was printed after printing a cyan color image. Note that, the dirt attached to the liquid absorbing member was solid component dirt of the coloring material and the emulsion resin contained in the ink, and fiber dirt such as dust and paper powder.

Next, in addition to the initializing steps, the cleaning step 5 was performed as follows. It is separately verified that there is no breakage of the liquid absorbing member in the material of the adhesive rubber roller used in the subsequent cleaning step and abutment conditions with the liquid absorbing member (not shown).

As illustrated in FIG. 7, the cleaning step 5 was performed with respect to the initializing steps of the liquid absorbing member illustrated in FIG. 6: liquid absorbing step 2→recovery liquid applying step 3→liquid collecting step 4. In the cleaning unit, an adhesive rubber roller 13*a* and a back-up roller 13*b* disposed to sandwich the liquid absorbing member therebetween were prepared. In each of the positions of 5A, 5B and 5C enclosed by one-dot chain lines, each cleaning step was performed, and a verification experiment was performed so as to confirm the variation in the cleaning performance depending on the position where the cleaning step was performed. As to the position of the cleaning step 5, the position 5A is between the liquid absorbing step 2 and the recovery liquid applying step 3, the position 5B is between the recovery liquid applying step 3 and the liquid collecting step 4 and the position 5C is between the liquid collecting step 4 and the liquid absorbing step 2.

The dirt attached to the liquid absorbing member was studied by using two kinds of dirt of the solid component dirt in the ink and paper powder on the fiber. Further, various conditions in this study are as follows. The results are indicated in Table 1.

Conveyance speed of transfer body and liquid absorbing member: 0.3 msec

Adhesive rubber roller conditions;

Rubber material•Hardness: Butyl rubber, 30° (Asker-C hardness)

Nip pressure/nip width: 9.8N/cm$^2$ (1.0 kgf/cm$^2$), 6 mm

Tack Force at the time of release between adhesive rubber-porous body (Dry State) in the above conditions: 3.9 N/cm$^2$ (0.4 kgf/cm$^2$)

As indicated in Table 1, in a case where the cleaning step 5 is disposed between the liquid absorbing step 2 and the recovery liquid applying step 3 (5A), solid component dirt in the ink was sufficiently removed, and image defects in the subsequent output image were eliminated. Also, paper powder on the fiber was removed at a level of not causing the image defects.

On the other hand, in a case where the cleaning step 5 is disposed between the recovery liquid applying step 3 and the liquid collecting step 4 (5B), solid component dirt in the ink was not sufficiently removed, and thereby image defects were found in the subsequent output image. Also, paper powder on the fiber was not sufficiently removed.

In a case where the cleaning step 5 is disposed between the liquid collecting step 4 and the liquid absorbing step 2 (5C), a case where the solid component dirt in the ink was removed and a case where the solid component dirt in the ink was not removed coexisted. For this reason, it is denoted by triangle in Table 1. On the other hand, as to the paper powder on the fiber, there was clearly excellent effect as compared with the cleaning performance in the above-described position 5A.

As described above, factors that cause the cleaning performance to change depending on the timing when the cleaning step is performed are considered below with reference to the description for the following two phenomena.

First, it is presumed that the cleaning performance relates to the tack force at the time of separation between the adhesive rubber and the porous body when the liquid absorbing member is sandwiched between the adhesive rubber roller and the back-up roller, and the nip portion is formed between the liquid absorbing member surface and the adhesive rubber roller, and the tack force at the time of separation changes depending on the amount of the liquid component held by the liquid absorbing member.

The liquid absorbing member is formed of a plurality of porous layers, and holds a liquid in a void portion of the porous layer. Further, the porous body is elastically deformed (crushed direction) by pressure to be pressed. That is, when the liquid absorbing member projects into the nip portion between the adhesive rubber roller and the back-up roller in a state where the amount of liquid held by the liquid absorbing member is large, the liquid leaks from the porous body to the nip portion. This phenomenon is separately verified by observing and examining the nip portion (not shown).

In the above verification experiments, in a case where the cleaning step was performed at the positions of 5A to 5C, the relative relationship of the amount of liquid held by the liquid absorbing member at each position was as indicated in Table 2. Further, the tack force at the time of separating the adhesive rubber and the porous body from each other was 3.9 N/cm$^2$ (0.4 kgf/cm$^2$) when the porous body was in a dry state. In contrast, in a case where the cleaning step 5 was disposed between the recovery liquid applying step 3 and the liquid collecting step 4 (5B), it was confirmed that the liquid absorbing member contained a larger amount of liquid as compared with the case in 5A, and the tack force at the time of separating the adhesive rubber and the porous body from each other was 0.98 N/cm$^2$ (0.1 kgf/cm$^2$) or less.

In this way, it was found that as the amount of the liquid held by the liquid absorbing member is larger, the amount of liquid to be ejected to the nip portion is increased, and the tack force at the time of separating the adhesive rubber and the porous body from each other is reduced. This phenomenon is particularly consistent with that sufficient cleaning performance was not obtained for paper powder and solid component dirt in the ink in terms of the cleaning performance between the recovery liquid applying step 3 and the liquid collecting step 4 (5B).

Here, in consideration of the arrangement of the cleaning steps based only on the above phenomenon, in a case where the cleaning step 5 is disposed between the liquid collecting step 4 and the liquid absorbing step 2 (5C) during which the liquid holding amount of the liquid absorbing member is the smallest, the best cleaning performance is supposed to be obtained. For this presumption, as indicated in Table 2, the cleaning performance of the paper powder is highly correlated with the amount of holding liquid of the liquid absorbing member, and the cleaning performance in the position 5C where the liquid holding amount of the liquid absorbing member is the smallest was a very good result. On the other hand, as to the solid component dirt in the ink, as described above, there are cases where it can be sufficiently removed and a case where it cannot be sufficiently removed, which is not consistent with the result of the cleaning performance of the paper powder.

In this regard, secondly, it was presumed that the cleaning performance is affected in some cases by the adhesive force of the dirt acting between the surface of the liquid absorbing member and the dirt (the tack force between the dirt and the porous body) depending on the kind of dirt attached to the surface of the liquid absorbing member.

In order to verify the above presumption, the following study was conducted. The liquid absorbing member illustrated in FIG. 7 was used to separate the recovery liquid applying unit 3 from the liquid absorbing member so that the liquid amount held by the liquid absorbing member is not changed in a state of being in a small amount, and the air blow of the liquid collecting unit 4 was turned off. The cleaning performance of solid component dirt in the ink was confirmed in a case where the liquid holding amount of the porous body was made constant. The results are indicated in Table 3.

In this study, the cleaning performance was excellent in the order of position 5A>5B>5C. The reason for this is presumed that the elapsed time until the dirt is attached to the liquid absorbing member surface in the liquid absorbing step 2 and reaches the cleaning step becomes longer in the order of the positions 5A, 5B and 5C, and thereby, the adhesive force generated on the dirt and the surface of the liquid absorbing member also becomes larger.

Figure 9A:
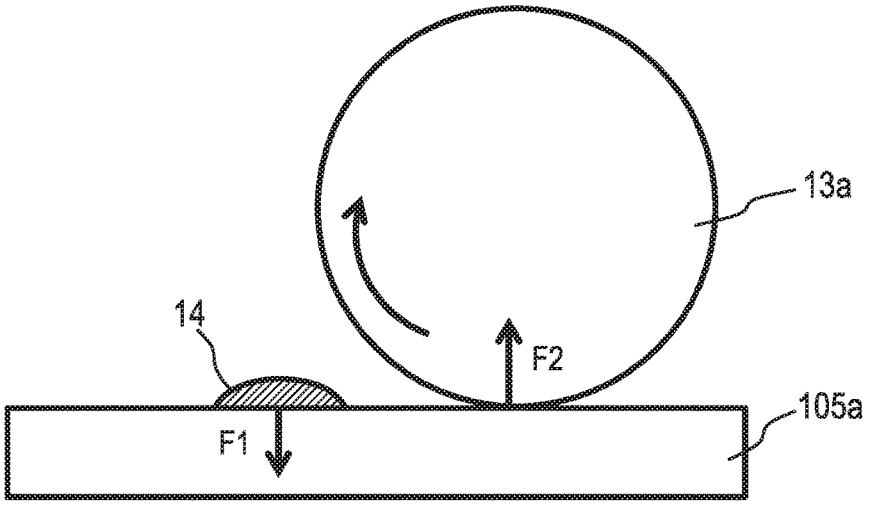
FIG. 9A is a diagram illustrating cleaning performance using a roller adhesion force and a tack force between dirt and a porous body.

From the above results, it is clear that the cleaning performance is related with at least a tack force F1 between dirt and the porous body (adhesive force by which dirt is attached to the surface of the porous body) and a tack force F2 at the time of separating the adhesive rubber and the porous body from each other (roller adhesive force of adhesive rubber roller). As illustrated in FIG. 9A, in a case where the tack force (roller adhesive force) F2 at the time of separating the adhesive rubber and the porous body from each other is larger than the tack force F1 between the dirt and the porous body, a dirt 14 is removed from the porous body 105*a*. Note that, it was found that the F1 has a correlation with the liquid holding amount of the porous body and the F2 has a correlation with the time when the dirt is attached to the surface of the porous body, but the degree of correlation changes depending on the kind of dirt.

Figure 9B:
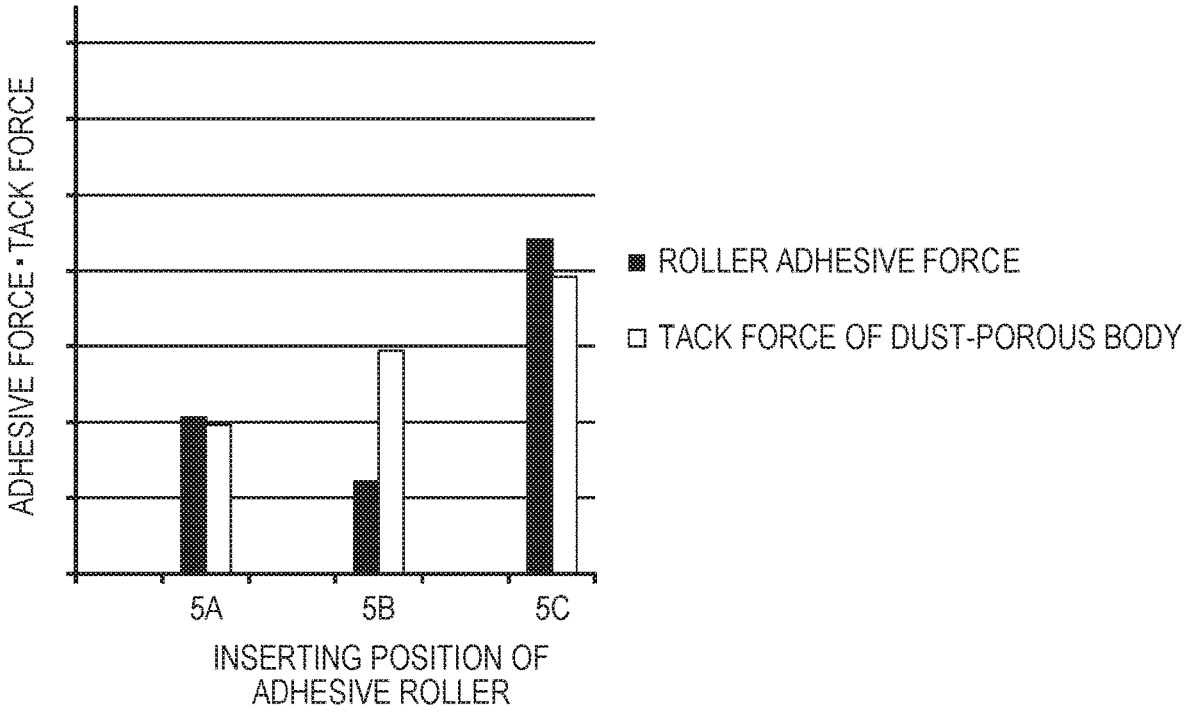
FIG. 9B is a diagram illustrating the roller adhesion force and the tack force between dirt and the porous body in a case where the cleaning step is performed in each position.

Therefore, as illustrated in FIG. 9B, as to the solid component dirt in the ink, it is presumed that the cleaning performance becomes higher in the position of 5A where the cleaning step 5 is disposed between the liquid absorbing step 2 and the recovery liquid applying step 3 in which the adhesive force F1 with which the dirt is attached to the surface of the porous body is the smallest, and the tack force F2 at the time of separating the adhesive rubber and the porous body from each other is the second largest. On the other hand, as to the paper powder, it is presumed that the liquid holding amount of the porous body greatly contributed to the cleaning performance, and thus the results indicated in Table 2 were obtained.

Even for both cases of the paper powder and the solid component dirt in the ink, in a case where the cleaning step 5 is disposed between the recovery liquid applying step 3 and the liquid collecting step 4 (5B), the cleaning performance was not sufficient as compared with the cleaning performance in the positions 5A and 5C. The reason for this is presumed that the tack force F2 becomes smaller as the liquid holding amount of the porous body is larger, and the tack force F1 between the dirt and the porous body is moderately large.

TABLE 1

| Position of inserting adhesive rubber roller | Cleaning performance | |
|---|---|---|
| | Solid component dirt in ink | Paper powder |
| Between liquid absorbing step and recovery liquid applying step (5A) | A | B |
| Between recovery liquid applying step and liquid collecting step (5B) | D | D |
| Between liquid collecting step and liquid absorbing step (5C) | C | A |

TABLE 2

| Position of inserting adhesive rubber roller | Liquid holding amount of porous body | Cleaning performance | |
|---|---|---|---|
| | | Paper powder | Solid component dirt in ink |
| Between liquid absorbing step and recovery liquid applying step (5A) | Middle | B | A |
| Between recovery liquid applying step and liquid collecting step (5B) | Large | D | D |
| Between liquid collecting step and liquid absorbing step (5C) | Small | A | C |

TABLE 3

| Position of inserting adhesive rubber roller | Solid component dirt in ink | | |
|---|---|---|---|
| | Cleaning performance | Liquid holding amount of porous body | Attaching force between dirt and porous body surface |
| Between liquid absorbing step and recovery liquid applying step (5A) | A | Small | Small |
| Between recovery liquid applying step and liquid collecting step (5B) | B | | Middle |
| Between liquid collecting step and liquid absorbing step (5C) | C | | Large |

According to the present invention, it is possible to provide an ink jet printing apparatus and an ink jet printing method which are capable of repeatedly removing dirt attached to the surface of the porous body, and capable of suppressing occurrence of image defects so as to realize stable image output even in a case of performing continuous image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet printing apparatus comprising:

an ink receiving medium;

an image forming unit that is configured to form a first image including a first liquid and a coloring material on the ink receiving medium by applying ink to the ink receiving medium;

a liquid absorbing member that includes a porous body having a first surface, the liquid absorbing member being configured to absorb at least a portion of the first liquid from the first image with the first surface contacting the first image;

a recovery liquid applying device that is configured to apply a recovery liquid having a viscosity lower than that of the ink to the porous body absorbing the first liquid;

a liquid collecting device that is configured to collect the first liquid absorbed by the porous body;

a liquid absorbing member conveyance device that is configured to convey the liquid absorbing member on a conveyance path; and a cleaning member that is configured to clean the porous body, wherein on the conveyance path of the liquid absorbing member, (1) a liquid absorbing unit that is configured to press the liquid absorbing member to the ink receiving medium from a second surface opposite to the first surface, (2) a recovery liquid applying unit in which the recovery liquid is applied by the recovery liquid applying device, and (3) a liquid collecting unit in which a liquid component absorbed by the porous body is to be collected by the liquid collecting device are arranged in this order, and wherein a cleaning unit configured to contact the first surface of the porous body with the cleaning member is disposed on the conveyance path at least between the liquid absorbing unit and the recovery liquid applying unit or between the liquid collecting unit and the liquid absorbing unit.

2. The ink jet printing apparatus according to claim 1, wherein the image forming unit applies a reaction liquid for a viscosity increase of an ink to the ink receiving medium before applying the ink, and wherein the recovery liquid has a viscosity lower than that of the reaction liquid.

3. The ink jet printing apparatus according to claim 1, wherein the cleaning unit is disposed between the liquid absorbing unit and the recovery liquid applying unit.

4. The ink jet printing apparatus according to claim 1, wherein the cleaning unit is disposed between the liquid collecting unit and the liquid absorbing unit.

5. The ink jet printing apparatus according to claim 1, wherein two or more cleaning units are arranged on the conveyance path of the liquid absorbing member, and wherein the cleaning unit is disposed between the liquid absorbing unit and the recovery liquid applying unit and between the liquid collecting unit and the liquid absorbing unit.

6. The ink jet printing apparatus according to claim 5, wherein a compressive elastic modulus of the cleaning member included in the cleaning unit disposed between the liquid collecting unit and the liquid absorbing unit is smaller than a compressive elastic modulus of the cleaning member included in the cleaning unit disposed between the liquid absorbing unit and the recovery liquid applying unit.

7. The ink jet printing apparatus according to claim 1, wherein the ink receiving medium is a transfer body for temporarily holding the first image and a second image in which at least a portion of the first liquid is removed from the first image, and wherein the second image on the transfer body is transferred to a printing medium for forming a final image.

8. The ink jet printing apparatus according to claim 1, wherein the ink receiving medium is a printing medium for forming a final image, and wherein a second image in which at least a portion of the first liquid is removed from the first image is formed on the printing medium.

9. The ink jet printing apparatus according to claim 1, further comprising a secondary cleaning member that cleans the cleaning member.

10. An ink jet printing apparatus comprising:

an ink receiving medium;

an image forming unit that is configured to form an ink image including a aqueous liquid component and a coloring material on the ink receiving medium by applying ink to the ink receiving medium;

a liquid absorbing member including a porous body having a first surface, the liquid absorbing member being configured to absorb at least a portion of the aqueous liquid component from the ink image with the first surface contacting the ink image so as to concentrate the ink constituting the ink image;

a recovery liquid applying device that is configured to apply a recovery liquid having a viscosity lower than that of the ink to the porous body absorbing the aqueous liquid component;

a liquid collecting device that is configured to collect the aqueous liquid component absorbed by the porous body;

a liquid absorbing member conveyance device that is configured to convey the liquid absorbing member on a conveyance path; and a cleaning member that is configured to clean the porous body, wherein on the conveyance path of the liquid absorbing member, (1) a liquid absorbing unit that is configured to press the liquid absorbing member to the ink receiving medium from a second surface opposite to the first surface, (2) a recovery liquid applying unit in which the recovery liquid is applied by the recovery liquid applying device, and (3) a liquid collecting unit in which a liquid component absorbed by the porous body is to be collected by the liquid collecting device are arranged in this order, and wherein a cleaning unit configured to contact the first surface of the porous body with the cleaning member is disposed on the conveyance path at least between the liquid absorbing unit and the recovery liquid applying unit or between the liquid collecting unit and the liquid absorbing unit.

* * * * *